US008084174B2

(12) United States Patent
Hasegawa et al.

(10) Patent No.: US 8,084,174 B2
(45) Date of Patent: Dec. 27, 2011

(54) TONER

(75) Inventors: Yusuke Hasegawa, Suntou-gun (JP); Yoshihiro Ogawa, Yokohama (JP); Kouji Nishikawa, Susono (JP); Kentarou Kamae, Mishima (JP); Takashige Kasuya, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/569,145

(22) Filed: Sep. 29, 2009

(65) Prior Publication Data

US 2010/0028793 A1 Feb. 4, 2010

Related U.S. Application Data

(63) Continuation of application No. PCT/JP2009/059652, filed on May 27, 2009.

(30) Foreign Application Priority Data

Jul. 25, 2008 (JP) ..... 2008-191730

(51) Int. Cl.
*G03G 9/00* (2006.01)

(52) U.S. Cl. ..... 430/106.2; 430/106.3

(58) Field of Classification Search ..... 430/106.2, 430/106.3

See application file for complete search history.

(56) References Cited

U.S. PATENT DOCUMENTS

| | | | | |
|---|---|---|---|---|
| 4,883,735 | A | 11/1989 | Watanabe et al. | 430/109 |
| 5,599,627 | A | 2/1997 | Aoki et al. | 428/403 |
| 5,856,055 | A * | 1/1999 | Ugai et al. | 430/108.23 |
| 5,874,019 | A * | 2/1999 | Uchida et al. | 428/404 |
| 6,013,193 | A | 1/2000 | Hashiuchi et al. | 252/62.59 |
| 6,059,988 | A | 5/2000 | Hashiuchi et al. | 252/62.58 |
| 6,780,555 | B2 * | 8/2004 | Uchida et al. | 430/106.2 |
| 6,803,164 | B2 | 10/2004 | Mizoo et al. | 430/106.2 |
| 7,368,211 | B2 | 5/2008 | Hasegawa et al. | 430/106.1 |
| 2002/0045120 | A1 | 4/2002 | Yoshikawa et al. | 430/108.5 |
| 2002/0098431 | A1 | 7/2002 | Fujikawa et al. | 430/106.2 |
| 2003/0044708 | A1 | 3/2003 | Matsunaga et al. | 430/108.22 |
| 2004/0110076 | A1 * | 6/2004 | Yamazaki et al. | 430/106.2 |
| 2007/0059627 | A1 * | 3/2007 | Fukui et al. | 430/110.3 |
| 2009/0186288 | A1 | 7/2009 | Hirata et al. | 430/106.2 |

FOREIGN PATENT DOCUMENTS

| | | |
|---|---|---|
| EP | 0 826 635 A1 | 3/1998 |
| EP | 2 016 466 A1 | 1/2009 |
| JP | 63-184762 | 7/1988 |
| JP | 03-161761 | 7/1991 |
| JP | 07-240306 | 9/1995 |
| JP | 10-072218 | 3/1998 |
| JP | 11-157843 | 6/1999 |
| JP | 11-189420 | 7/1999 |
| JP | 2000-056518 | 2/2000 |
| JP | 2000-272923 | 10/2000 |
| JP | 2002-221813 | 8/2002 |
| JP | 2002-341598 | 11/2002 |
| JP | 2003-084501 | 3/2003 |
| JP | 2003-255575 | 9/2003 |
| JP | 2004-078055 | 3/2004 |
| JP | 2004-157342 | 6/2004 |
| JP | 2004-161551 | 6/2004 |
| JP | 2004-354810 | 12/2004 |
| JP | 2006-047367 | 2/2006 |
| JP | 2006-113313 | 4/2006 |
| JP | 2006-133734 | 5/2006 |
| JP | 2007-316629 | 12/2007 |

* cited by examiner

*Primary Examiner* — Thorl Chea

(74) *Attorney, Agent, or Firm* — Fitzpatrick, Cella, Harper & Scinto

(57) ABSTRACT

An object of the present invention is to provide a toner excellent in ability to prevent electrostatic offset and fixation tailing. Provided is a toner including toner particles each containing at least a binder resin, a wax, and a magnetic iron oxide, and inorganic fine particles, in which the magnetic iron oxide contains at least a Ti component, an Al component, an Si component, and an Fe component; and the each component has some particular characteristics.

7 Claims, No Drawings

TONER

BACKGROUND OF THE INVENTION

1. Field of the Invention

The present invention relates to a toner for use in an image-forming method such as an electrophotographic method, an electrostatic recording method, an electrostatic printing method, or a toner jet type recording method.

2. Description of the Related Art

Image-forming apparatuses have already entered widespread use as information output instruments linked to other information instruments because digitalization of the apparatuses is now able to store information as a digital signal. In addition, each of the image-forming apparatuses has been strongly requested to, for example, be available at a reduced cost and correspond to various media owing to the diversification of methods by which a user uses the apparatus as well as to show, for example, the following ability: the apparatus can form a high-definition, high-grade, high-quality image at a high speed with high reliability.

The achievement of a reduction in cost at which an image-forming apparatus is available ineluctably requires the simplification of each image-forming process in the apparatus; particularly in the case of a high-priced machine having high productivity, various functions that can be mounted on the machine must be omitted to the extent possible for reducing the cost for the machine. On the other hand, in order that an image-forming apparatus may be able to cater to the demands for a high grade, high image quality, high reliability, and the like, the number of characteristics requested of toner and each key part in the apparatus has been increasing without cessation.

In addition, problems that previously hardly came to the surface heretofore have started to become evident owing to the diversification of: areas where users use image-forming apparatuses; environments under which the users use the apparatuses; and methods by which the users use the apparatuses.

For example, some problems occur remarkably when paper having a high degree of surface unevenness such as recycled paper or bond paper is used, though the problems are hardly regarded as being troublesome when relatively smooth paper such as coated paper for color printing is used.

One of the problems is electrostatic offset. The electrostatic offset hardly occurs on paper having high surface smoothness such as coated paper, but is apt to occur on paper having a high degree of surface unevenness such as recycled paper.

The electrostatic offset means the following phenomenon: upon passage of paper onto which an unfixed toner image has been transferred through a fixing nip portion between the fixing film and pressure roller of a fixing unit, partially molten toner present at a depressed portion of the paper flies toward the fixing film, and, after the fixing film has rotated once, the toner that has flown toward the fixing film fixes on the paper. The phenomenon becomes remarkable under a low-temperature, low-humidity environment; the phenomenon becomes additionally remarkable particularly in an isolated dot image disadvantageous in terms of fixing performance on paper because an adhesive force between toner hardly acts in the image.

Similarly, fixation tailing is apt to occur on paper having a high degree of surface unevenness. The fixation tailing is the following phenomenon: upon entry of paper onto which unfixed toner line images have been transferred into a fixing nip portion, water vapor in the paper explodes at a depressed portion of the paper to blow off a subsequent line image, with the result that the image tails. The phenomenon becomes remarkable particularly under a high-temperature, high-humidity environment; the phenomenon becomes additionally remarkable on paper that has been left to stand under a high-temperature, high-humidity environment. In addition, those problems are apt to be remarkable in a machine having a high process speed where the fixing performance of toner is apt to deteriorate because the problems are apt to be additionally remarkable when a toner image on paper is not completely molten.

Such problems relating to the fixation of toner can be reduced by changing the constitution of a fixing unit or controlling a fixing bias. However, measures against the constitution of the main body of an image-forming apparatus are not preferable because the measures are in a trade-off relationship with such reduction in cost for the apparatus as described above.

Meanwhile, investigations on a charge control resin as a charge control agent have been underway in recent years from the viewpoints of the control of triboelectric charging and safety. For example, a method involving the use of a polymer of a styrene-based monomer and 2-acrylamide-2-methylsulfonic acid has been disclosed (Patent Document 1). In addition, a method involving the use of a polymer of a styrene-based monomer and 2-acrylamide-2-methylsulfonic acid as a charge control agent for a polyester resin has been disclosed (Patent Document 2). Further, a toner containing a sulfonic group-containing (meth) acrylamide copolymer having a specific glass transition temperature as a charge control agent has been disclosed (Patent Document 3). However, none of those documents refers to electrostatic offset and tailing in a fixing process, though those methods and toner have the following characteristic in common: excellent triboelectric charge-providing performance.

In addition, attempts have been made to use two kinds, i.e., any such charge control resin as described above and another charge control agent in combination with a view to achieving an additional improvement in developing performance of toner. For example, attempts have been made to improve the charging performance and developing performance of toner by using a charge control resin and an aromatic oxycarboxylic acid-based charge control agent in combination (Patent Documents 4 and 5). In addition, attempts have been made to improve the developing performance of toner under a high-temperature, high-humidity environment by controlling a monomer amount in a charge control resin (Patent Document 6). Further, attempts have been made to achieve an additional improvement in performance of a toner containing a charge control resin by paying attention to the dielectric characteristic of the toner (Patent Documents 7 and 8). Meanwhile, a certain document describes an improving effect of, for example, a system obtained by further incorporating an azo-based iron compound into a toner containing a charge control resin on the developing performance of the toner by paying attention to the moisture absorption of the toner (Patent Document 9).

All of those attempts are aimed at an effect in a developing portion in an image-forming process, and an improving effect on the developing performance of toner has been actually observed in each of the attempts. However, none of the documents refers to the behavior of the toner before and after its passage through a fixing nip, so the documents are susceptible to improvement in terms of electrostatic offset and tailing each having the following characteristic: the behavior of the toner in a fixing process rather than in a developing process plays a pivotal role in its occurrence.

The following fact has been generally known: in the case of a magnetic toner for use in a one-component developing system advantageous for a reduction in size of an image-forming apparatus, the states of dispersion of magnetic iron oxide particles in the magnetic toner and the physical properties of the iron oxide particles themselves significantly affect, for example, various characteristics requested of the toner, such as a developing characteristic and durability, and the deterioration of the toner.

For example, when the magnetic iron oxide particles are insufficiently dispersed in the particles of the magnetic toner, the total amounts of the magnetic iron oxide particles exposed to the surfaces of the toner particles vary from toner particle to toner particle. When the amount of the magnetic iron oxide particles on the surface of a toner particle is small, upon triboelectric charging with a charge-providing member (which may hereinafter be referred to as "developing sleeve"), the surface of the toner particle is charged to a large extent, and in some cases, the surface is excessively charged. In contrast, when the magnetic iron oxide particles are present in an excessive amount on the surface of a toner particle, the charge of the toner is apt to leak from the magnetic iron oxide particles. As a result, the toner hardly obtains a large charge quantity. In addition, toner with reverse polarity is apt to generate owing to contact between any such magnetic substance particle and a binder resin, so the charging distribution of the toner is apt to widen.

When the charge of the toner is apt to leak from the above magnetic iron oxide particles and the charge quantity distribution of the toner is wide, the charging stability of the toner is apt to be insufficient in the latter half of the service life of a recent long-life cartridge. Accordingly, particularly when the cartridge is left to stand in the latter half of its service life, a reduction in density and fogging at the time of the start-up of the image-forming apparatus in the morning are apt to be remarkable after the cartridge has been left to stand overnight.

The phenomena are apt to be additionally remarkable when a large number of images each having a relatively low print percentage are printed with a large-capacity cartridge filled with a large amount of toner because the charge quantity distribution of the toner fed to the developing sleeve is apt to widen.

In particular, the electrostatic offset and the fixation tailing described above are apt to be worse when the charge of the toner on paper is apt to leak. Therefore, as described above, it is important to control the states of dispersion of the magnetic iron oxide particles in the toner and the physical properties of the magnetic iron oxide particles themselves.

A large number of proposals have been conventionally made on improvements in flowability and resistance of a magnetic iron oxide in a magnetic toner through the incorporation of a specific element into the surface and inside of the magnetic iron oxide.

For example, a magnetic particle powder having the following characteristics has been disclosed (Patent Document 10): the powder contains 0.10 to 1.00 mass % of Si, a coprecipitate of silica and alumina is present on the surface of the powder, and further, an oxide particle or water-containing oxide particle of an element selected from Fe, Ti, Zr, Si, and Al adheres onto the coprecipitate.

In addition, an iron oxide particle having the following characteristic has been disclosed (Patent Document 11): the particle is coated with a composite iron oxide layer containing Ti and Fe.

Further, a toner containing a magnetic iron oxide having the following characteristics has been disclosed (Patent Document 12): the magnetic iron oxide contains at least Si, Zn, and Ti, and the dissolution ratio of each of the elements when a portion ranging from the surface of the magnetic iron oxide to a depth corresponding to 5% of the radius of the magnetic iron oxide is dissolved is specified.

Each of those attempts has achieved improvements in flowability and resistance of a magnetic substance to some extent through the localization of Ti or Zn on the outermost surface layer of the magnetic substance. However, the attempts are insufficient in terms of the control of the dielectric loss tangent of toner largely involved in electrostatic offset and tailing.

In addition, a magnetite particle having the following characteristics has been disclosed (Patent Document 13): the particle contains a silicon component continuously from its center to its surface, its outer shell is coated with a metal compound formed of at least one kind of a metal component selected from Zn, Mn, Cu, Ni, Co, Cr, Cd, Al, Sn, Mg, and Ti bonded to the silicon component, and the particle is provided with such a gradient that the concentration of the above metal component with respect to Fe in the outer shell portion of the particle is higher than that in the inner shell portion of the particle and such concentration in the surface layer portion of the particle is additionally high. Further, an iron oxide particle having the following characteristic has been disclosed (Patent Document 14): a core particle from which a silicon component is exposed is coated with an Al component.

Each of those attempts exerts its effect by controlling the abundance of an element when a portion ranging from the surface of any such particle to a depth corresponding to 20% or 40% of the radius of the particle is dissolved. However, the attempts are insufficient to alleviate electrostatic offset and fixation tailing particularly on paper having a high degree of surface unevenness because the physical properties of the vicinity of the surface of toner ranging from the surface to a depth corresponding to about 10% of the radius of the toner play an important role in controlling the dielectric loss tangent of the toner largely involved in electrostatic offset and tailing.

That is, at present, a toner containing a magnetic iron oxide and having the following characteristics has been absent: the toner can of course maintain its excellent charging stability irrespective of an environment under which the toner is used, and sufficient measures against electrostatic offset and fixation tailing are taken by paying attention to a fixing process.

Patent Document 1: JP 63-184762 A
Patent Document 2: JP 3-161761 A
Patent Document 3: JP 2000-56518 A
Patent Document 4: JP 2006-113313 A
Patent Document 5: JP 2006-47367 A
Patent Document 6: JP 2003-255575 A
Patent Document 7: JP 2004-157342 A
Patent Document 8: JP 2002-341598 A
Patent Document 9: JP 2004-78055 A
Patent Document 10: JP 7-240306 A
Patent Document 11: JP 2004-161551 A
Patent Document 12: JP 2004-354810 A
Patent Document 13: JP 3224774 B
Patent Document 14: JP 3544316 B

SUMMARY OF THE INVENTION

Therefore, the present invention has been made with a view to alleviating the drawbacks of the prior art in view of such circumstances as described above in the prior art.

That is, an object of the present invention is to provide a toner excellent in ability to prevent electrostatic offset and fixation tailing.

Another object of the present invention is to provide a toner having the following characteristics: even when the toner is left to stand in the latter half of the service life of a large-capacity, long-life cartridge, the toner is excellent in charge rising performance, and provides a good image having a high image density and free of fogging.

As a result of extensive studies, the inventors of the present invention have found that the objects of the present invention can be achieved by using any such toner as described below, and have completed the present invention. That is, the present invention is as follows:

[1] A toner, including:

toner particles each containing at least a binder resin, a wax, and a magnetic iron oxide; and inorganic fine particles, in which:

the magnetic iron oxide has the following characteristics:

(1) the magnetic iron oxide contains at least a Ti component, an Al component, an Si component, and an Fe component;

(2) a content of the Ti component in terms of a Ti element is 0.30 mass % or more and 5.00 mass % or less with respect to an entirety of the magnetic iron oxide;

(3) a content of the Al component in terms of an Al element is 0.10 mass % or more and 3.00 mass % or less with respect to the entirety of the magnetic iron oxide;

(4) an Al component amount eluted when the magnetic iron oxide is loaded into an alkaline aqueous solution and the Al component in the magnetic iron oxide is eluted with the alkaline aqueous solution is 50.0% or more and 95.0% or less of a total Al component amount in the magnetic iron oxide;

(5) when the magnetic iron oxide after the Al component in the magnetic iron oxide has been eluted with the alkaline aqueous solution is further dissolved in an acidic aqueous solution so that a solution is obtained, and an Fe element amount in a solution in which the magnetic iron oxide is completely dissolved is defined as a total Fe element amount, a sum of an Al component amount in a solution prepared by dissolving the magnetic iron oxide until 10 mass % of the total Fe element amount is present in the solution (the solution being hereinafter referred to as a solution with an Fe element dissolution ratio of 10 mass %) and the Al component amount eluted in the section (4) accounts for 95.0% or more and 100.0% or less of the total Al component amount in the magnetic iron oxide; and (6) a ratio (Ti component amount in terms of Ti element/Al component amount in terms of Al element) of a Ti component amount in terms of the Ti element in the solution with an Fe element dissolution ratio of 10 mass % to the Al component amount in terms of the Al element in the solution is 2.0 or more and 30.0 or less; and the toner has a dielectric loss tangent calculated from its complex dielectric constant measured at a temperature of 140° C. and a frequency of 10 kHz of $1.0\times10^{-3}$ to $5.0\times10^{-1}$.

[2] A toner according to the section [1], in which an Si component amount eluted when the magnetic iron oxide is loaded into the alkaline aqueous solution and the Si component in the magnetic iron oxide is eluted with the alkaline aqueous solution is 5.0% or more and 30.0% or less of a total Si component amount in the magnetic iron oxide.

[3] A toner according to the section [1] or [2] in which a ratio (Ti component amount in terms of Ti element/Si component amount in terms of Si element) of the Ti component amount in terms of the Ti element in the solution with an Fe element dissolution ratio of 10 mass % to an Si component amount in terms of the Si element in the solution is 1.0 or more and 5.0 or less.

[4] A toner according to any one of the sections [1] to [3], in which the toner particles each contain a polymer A having a sulfonic group, a sulfonate group, or a sulfonic acid ester group.

[5] A toner according to any one of the sections [1] to [3], in which the toner particles each contain a polymer A having a sulfonic group, a sulfonate group, or a sulfonic acid ester group and a metal compound B of an aromatic oxycarboxylic acid or a derivative of the acid.

[6] A toner according to any one of the sections [1] to [3], in which the toner particles each contain a polymer A having a sulfonic group, a sulfonate group, or a sulfonic acid ester group, a metal compound B of an aromatic oxycarboxylic acid or a derivative of the acid, and an azo-based iron compound C.

According to the present invention, a toner excellent in ability to prevent electrostatic offset and fixation tailing may be provided. According to the present invention, a toner having the following characteristics may be provided: even when the toner is left to stand in the latter half of the service life of a large-capacity, long-life cartridge, the toner is excellent in charge rising performance, and provides a good image having a high image density and free of fogging.

Further features of the present invention will become apparent from the following description of exemplary embodiments.

DESCRIPTION OF THE EMBODIMENT

A toner of the present invention includes: toner particles each containing at least a binder resin, a wax, and a magnetic iron oxide; and inorganic fine particles, in which the magnetic iron oxide has the following characteristics:

(1) the magnetic iron oxide contains at least a Ti component, an Al component, an Si component, and an Fe component;

(2) a content of the Ti component in terms of a Ti element is 0.30 mass % or more and 5.00 mass % or less with respect to an entirety of the magnetic iron oxide;

(3) a content of the Al component in terms of an Al element is 0.10 mass % or more and 3.00 mass % or less with respect to the entirety of the magnetic iron oxide;

(4) an Al component amount eluted when the magnetic iron oxide is loaded into an alkaline aqueous solution and the Al component in the magnetic iron oxide is eluted with the alkaline aqueous solution is 50.0% or more and 95.0% or less of a total Al component amount in the magnetic iron oxide;

(5) when the magnetic iron oxide after the Al component in the magnetic iron oxide has been eluted with the alkaline aqueous solution is further dissolved in an acidic aqueous solution so that a solution is obtained, and an Fe element amount in a solution in which the magnetic iron oxide is completely dissolved is defined as a total Fe element amount, a sum of an Al component amount in a solution prepared by dissolving the magnetic iron oxide until 10 mass % of the total Fe element amount is present in the solution (the solution being hereinafter referred to as a solution with an Fe element dissolution ratio of 10 mass %) and the Al component amount eluted in the section (4) accounts for 95.0% or more and 100.0% or less of the total Al component amount in the magnetic iron oxide; and (6) a ratio (Ti component amount in terms of Ti element/Al component amount in terms of Al element) of a Ti component amount in terms of the Ti element in the solution with an Fe element dissolution ratio of 10 mass % to the Al component amount in terms of the Al element in the solution is 2.0 or more and 30.0 or less; and the toner has a dielectric loss tangent calculated from its complex dielectric constant measured at a temperature of 140° C. and a frequency of 10 kHz of $1.0\times10^{-3}$ to $5.0\times10^{-1}$.

As described above, the toner of the present invention can exert an effect of the present invention because the toner uses a specific magnetic iron oxide, and the toner has a dielectric loss tangent calculated from its complex dielectric constant measured at a temperature of 140° C. and a frequency of 10 kHz (which may hereinafter be simply referred to as "dielectric loss tangent of the toner") of $1.0\times10^{-3}$ to $5.0\times10^{-1}$.

As a result of various investigations, the inventors of the present invention have found that the technical meaning of setting the dielectric loss tangent of the toner within the above range with the specific magnetic iron oxide is as described below. In other words, charging relaxation in the toner on paper immediately before its entry into a fixing nip is effectively suppressed, so the toner can maintain a large charge quantity. As a result, an electrostatic adsorbing force strongly acts on the paper, so electrostatic offset and fixation tailing hardly occur.

That is, the following procedure plays an important role in preventing the occurrence of the electrostatic offset and the fixation tailing: the charge quantity of the toner on paper is made large, and is maintained at a high level. In the present invention, the objects of the present invention were attained by using the specific magnetic iron oxide, and controlling the dielectric loss tangent of the toner to $10\times10^{-3}$ to $5.0\times10^{-1}$.

Here, the electrostatic offset is a phenomenon occurring when an insufficiently molten toner near a fixing nip flies toward a fixing member (fixing film).

In particular, in the case where the toner is a toner containing toner particles in each of which a magnetic substance is insufficiently dispersed or a toner having such prescription as to be apt to be charged excessively, an excessively charged toner is apt to accumulate on the lower layer of a developing sleeve. In that case, the toner in a toner coat upper layer portion on the developing sleeve is hardly provided with a charge quantity. As a result, the charge quantity distribution of the toner is apt to widen. Accordingly, the charge quantity of the toner on the paper before its entry into the fixing nip is apt to be small, and the electrostatic offset is apt to be worse. Further, under a low-temperature, low-humidity environment, the electrostatic offset is apt to be remarkable because the toner is apt to be charged excessively, and the fixing performance of the toner is apt to be insufficient.

In addition, when paper having a high degree of surface unevenness is used, the amount of the insufficiently molten toner is apt to be large at a depressed portion, so the electrostatic offset is apt to be additionally remarkable; the phenomenon becomes additionally remarkable particularly in an isolated dot image disadvantageous in terms of fixing performance on paper because an adhesive force between toner particles hardly acts in the image.

Meanwhile, the fixation tailing is the following phenomenon: upon entry of paper onto which unfixed toner line images have been transferred into the fixing nip portion, water vapor in the paper explodes at a depressed portion of the paper to blow off a subsequent line image, with the result that the image tails. Here, when the charge quantity of the toner is small, upon output of a line image, a toner laid-on level on the line is apt to be high. Accordingly, the toner is brought into such a state as to be apt to be blown off at the time of the entry into the fixing nip, and the fixation tailing is apt to be worse. The fixation tailing is apt to be remarkable particularly under a high-temperature, high-humidity environment where the amount of water vapor produced from the paper is large. Further, the fixation tailing becomes particularly remarkable when the charge quantity of the toner is apt to reduce such as the time of the start-up of an image-forming apparatus in the morning after the toner has been left to stand overnight.

As in the case of the electrostatic offset, the fixation tailing is apt to occur on paper having a high degree of surface unevenness because water vapor is apt to accumulate in a depressed portion of the paper having a high degree of surface unevenness, and the accumulated water vapor explodes at the time of fixation with the depressed portion as an epicenter. In particular, paper left to stand under a high-temperature, high-humidity environment is apt to exacerbate the fixation tailing because the paper contains a large amount of moisture.

As described above, the inventors of the present invention have found that a solution to the above problems is as follows: a specific magnetic iron oxide is used in the composition of the toner, and the dielectric loss tangent of the toner is controlled within a specific range.

That is, the dielectric loss tangent of the toner of the present invention is $1.0\times10^{-3}$ to $5.0\times10^{-1}$, preferably $2.0\times10^{-3}$ to $4.8\times10^{-1}$, or more preferably $3.0\times10^{-3}$ to $4.6\times10^{-1}$.

As long as the above dielectric loss tangent of the toner is $1.0\times10^{-3}$ to $5.0\times10^{-1}$, even when the toner on paper enters the fixing nip to be exposed to high temperatures, the charging relaxation of the toner can be effectively suppressed, so the toner can easily maintain its charge quantity, and the electrostatic offset and the fixation tailing hardly become worse. Although the reason why the behavior of the toner instantaneously provided with heat at the fixing nip correlates with the dielectric loss tangent calculated from the complex dielectric constant of the toner measured at a temperature of 140° C. and a frequency of 10 kHz is unclear, the reason is probably as follows: the temperature of heat instantaneously provided for the toner which enters a depressed portion of the paper and which does not directly contact the heated fixing film can be approximated to 140° C. In addition, the measurement was performed at a frequency of 10 kHz, which was a sufficiently high frequency, because a measuring device is apt to pick up noises at low frequencies, and an error is apt to be large. It should be noted that the above dielectric loss tangent of the toner can be adjusted to fall within the above range by controlling, for example, the amount of each element added to the magnetic iron oxide, the existence distribution of each element, and the addition amount of each of a polymer A, a compound B, and a compound C to be described later.

The magnetic iron oxide used in the present invention has the following characteristics:

(1) the magnetic iron oxide contains at least a Ti component, an Al component, an Si component, and an Fe component;

(2) a content of the above Ti component in terms of a Ti element is 0.30 mass % or more and 5.00 mass % or less, preferably 0.30 mass % or more and 4.00 mass % or less, or more preferably 0.30 mass % or more and 3.00 mass % or less with respect to the entirety of the above magnetic iron oxide;

(3) a content of the above Al component in terms of an Al element is 0.10 mass % or more and 3.00 mass % or less, preferably 0.10 mass % or more and 2.50 mass % or less, or more preferably 0.10 mass % or more and 2.00 mass % or less with respect to the entirety of the above magnetic iron oxide;

(4) an Al component amount eluted when the above magnetic iron oxide is loaded into an alkaline aqueous solution with the alkaline aqueous solution is for 50.0% or more and 95.0% or less, preferably 55.0% or more and 95.0% or less, or more preferably 60.0% or more and 95.0% or less of a total Al component amount in the magnetic iron oxide;

(5) when the magnetic iron oxide after the Al component in the above magnetic iron oxide has been eluted with the above alkaline aqueous solution is further dissolved in an acidic aqueous solution so that a solution is obtained, and an Fe element amount in a solution in which the magnetic iron oxide is completely dissolved is defined as a total Fe element amount, a sum of an Al component amount in a solution prepared by dissolving the above magnetic iron oxide until 10 mass % of the total Fe element amount is present in the solution (the solution also being hereinafter referred to as a solution with an Fe element dissolution ratio of 10 mass %) and the Al component amount eluted in the above section (4) accounts for 95.0% or more and 100.0% or less, preferably 96.0% or more and 100.0% or less, or more preferably 97.0% or more and 100.0% or less of the total Al component amount in the above magnetic iron oxide; and (6) a ratio (Ti component amount in terms of Ti element/Al component amount in terms of Al element) of a Ti component amount in terms of the Ti element in the above solution with an Fe element dissolution ratio of 10 mass % to the Al component amount in terms of the Al element in the solution is 2.0 or more and 30.0 or less, preferably 2.2 or more and 25.0 or less, or more preferably 2.5 or more and 20.0 or less.

The Fe component and the Ti component are each eluted to a very little extent in the eluting process with the alkaline aqueous solution of the above section (4). That is, only the Al component in the outermost surface layer of the magnetic iron oxide may be eluted (when the outermost surface layer contains the Si component, the Si component may also be eluted).

In addition, it is important that the sum of the Al component amount in the above solution with an Fe element dissolution ratio of 10 mass % and the Al component amount eluted in the above section (4) accounts for 95.0% or more and 100.0% or less of the total Al component amount in the above magnetic iron oxide.

The above magnetic iron oxide is apt to have a high resistance when the Al component amount eluted in the above section (4) (Al component amount in the outermost surface layer of the magnetic iron oxide) is relatively large as compared to the total Al component amount in the magnetic iron oxide, and the Al component amount in the above solution with an Fe element dissolution ratio of 10 mass % is small as compared to the total Al component amount in the magnetic iron oxide.

Accordingly, even when a large amount of the magnetic iron oxide is exposed to part of the toner surface, the dielectric loss tangent of the toner can be easily controlled within the range intended by the present invention by virtue of a relatively high resistance of the magnetic iron oxide, though the reason for the foregoing is unclear. As a result, the charge quantity of the toner on paper can be easily maintained.

The case where the Al component amount eluted in the above section (4) accounts for less than 50.0% of the total Al component amount in the magnetic iron oxide means that the Al component amount in the outermost surface layer of the magnetic iron oxide is small, so the resistance of the magnetic iron oxide tends to reduce.

On the other hand, in the case where the Al component amount eluted in the above section (4) accounts for more than 95.0% of the total Al component amount in the magnetic iron oxide, the Al component amount in the above solution with an Fe element dissolution ratio of 10 mass % tends to reduce, so it becomes difficult to control the dielectric loss tangent at a high temperature.

In addition, the case where the sum of the Al component amount in the above solution with an Fe element dissolution ratio of 10 mass % and the Al component amount eluted in the above section (4) accounts for less than 95.0% of the total Al component amount in the above magnetic iron oxide means that the Al component amount in the outermost surface layer of the magnetic iron oxide is small, so the resistance of the magnetic iron oxide tends to reduce.

In each of those cases, the charging relaxation of the toner is apt to be large particularly when the toner on the paper is exposed to high temperatures, so the effect of the present invention is hardly exerted.

Further, in the present invention, it is important that a ratio (Ti component amount in terms of Ti element/Al component amount in terms of Al element) of the Ti component amount in terms of the Ti element in the above solution with an Fe element dissolution ratio of 10 mass % to the Al component amount in terms of the Al element in the solution be 2.0 or more and 30.0 or less.

The dielectric loss tangent of the toner at a high temperature cannot be easily controlled within the range intended by the present invention until the ratio [Ti component amount in terms of Ti element/Al component amount in terms of Al element] (which may hereinafter be simply referred to as "ratio [Ti/Al]") falls within the above range, though the reason for the foregoing is unclear.

The foregoing is probably caused by a synergistic effect of the Ti component having high heat resistance and the Al component having a high resistance. That is, even when only the Al component out of them is present, an increase in resistance of the magnetic iron oxide can be easily attained at normal temperature, but, when the toner is exposed to an environment having a high temperature of 100° C. or higher, the charge of the toner is apt to leak through a portion formed of the Al component and the Fe component around the Al component, so the dielectric loss tangent of the toner may be apt to increase. On the other hand, as long as a large amount of the Ti component having a low heat conductivity is present around the Al component, even when the toner is exposed to a high-temperature environment, an increase in resistance of the magnetic iron oxide by the Al component can be easily maintained, so the dielectric loss tangent of the toner may hardly increase. In addition, the Ti component itself has a relatively high resistance, so the presence of an excessive amount of the Ti component as compared to that of the Al component may suppress the occurrence of a detrimental effect such as a reduction in resistance of the magnetic iron oxide.

When the above ratio [Ti/Al] is smaller than 2.0, the magnetic iron oxide is apt to be affected by heat, so the dielectric loss tangent of the toner at a high temperature is apt to increase. On the other hand, when the ratio [Ti/Al] is larger than 30.0, the resistance of the magnetic iron oxide is apt to reduce, with the result that the dielectric loss tangent of the toner is apt to increase.

As described above, the adjustment of the above ratio [Ti/Al] plays a pivotal role in controlling the dielectric loss tangent of the toner at a high temperature; in the case of a toner free of any Al component like Patent Document 11 or 12 described above, or the like, or a toner which partially contained Al and Ti but in which the above ratio [Ti/Al] was not adjusted like Patent Document 10, 13, 14, or the like, it was difficult to control the dielectric loss tangent of such toner at a high temperature, and the electrostatic offset and the fixation tailing could not be alleviated.

It is important that the magnetic iron oxide used in the present invention contain the Ti component and the Al component at the above contents.

When the contents of the Ti component and the Al component fall within the above ranges, the Al component amount in the outermost surface layer of the magnetic iron oxide and the above ratio [Ti/Al] can be controlled.

When the content of the Ti component in terms of the Ti element is smaller than 0.30 mass % with respect to the entirety of the magnetic iron oxide, the heat resistance of the magnetic iron oxide is apt to reduce. As a result, the magnetic iron oxide is apt to be affected by heat at the time of the production of the toner, the resistance of the magnetic iron oxide is apt to reduce, and the dielectric loss tangent of the toner is apt to increase. On the other hand, when the content is larger than 5.00 mass %, the saturation magnetization of the magnetic iron oxide tends to reduce, and a magnetic cohesive force between toner becomes insufficient. As a result, fogging is apt to be worse when the toner is used again after having been left to stand for a certain time period without being used.

When the content of the Al component in terms of the Al element is smaller than 0.10 mass % with respect to the entirety of the magnetic iron oxide, the resistance of the magnetic iron oxide is apt to reduce, and the dielectric loss tangent of the toner is apt to increase.

On the other hand, when the content is larger than 3.00 mass %, the specific surface area of the magnetic iron oxide is apt to increase, so the moisture absorption of the magnetic iron oxide increases. As a result, the environmental stability of the toner is apt to reduce; for example, the density of an image formed with the toner is apt to reduce when the toner is used again after having been left to stand for a certain time period without being used.

In addition, the magnetic iron oxide of the present invention contains the Si component at a content in terms of the Si element of preferably 0.10 mass % or more and 4.00 mass % or less, more preferably 0.15 mass % or more and 3.50 mass % or less, or still more preferably 0.20 mass % or more and 3.00 mass % or less with respect to the entirety of the magnetic iron oxide. When the magnetic iron oxide contains the Si component at a content within the above range, good dispersing performance of the magnetic iron oxide in each toner particle can be easily attained.

When the magnetic iron oxide is favorably dispersed in each toner particle, the amount of the magnetic iron oxide exposed to the surface of the toner particle becomes relatively small, and at the same time, the amount of agglomerating magnetic iron oxide particles reduces. Accordingly, the number of routes through which charge leaks in each toner particle can be reduced. As a result, the charging relaxation of the toner can be additionally suppressed.

Further, an Si component amount eluted when the magnetic iron oxide of the present invention is loaded into an alkaline aqueous solution having the same composition as that of the above section (4) and the Si component in the magnetic iron oxide is eluted with the above alkaline aqueous solution is preferably 5.0% or more and 30.0% or less, more preferably 8.0% or more and 27.0% or less, or still more preferably 10.0% or more and 25.0% or less of the total Si component amount in the magnetic iron oxide.

When the Si component amount eluted with the alkaline aqueous solution in the outermost surface layer of the magnetic iron oxide with respect to the total Si component amount in the magnetic iron oxide falls within the above range, the magnetic iron oxide can easily maintain its high resistance, and good dispersing performance of the magnetic iron oxide in each toner particle can be easily attained.

When the Si component amount eluted with the alkaline aqueous solution in the outermost surface layer of the magnetic iron oxide accounts for less than 5.0% of the total Si component amount in the magnetic iron oxide, the dispersing performance of the magnetic iron oxide in each toner particle tends to reduce to some extent. When the Si component amount accounts for more than 30.0% of the total Si component amount, the following tendency arises: the surface of the magnetic iron oxide shows increased moisture absorptivity, so a reduction in density of an image output with the toner is apt to occur.

Further, a ratio [Ti component amount in terms of Ti element/Si component amount in terms of Si element] of the Ti component amount in terms of the Ti element in the above solution with an Fe element dissolution ratio of 10 mass % to the Si component amount in terms of the Si element in the solution (which may hereinafter be simply referred to as "ratio [Ti/Si]") is preferably 1.0 or more and 5.0 or less, more preferably 1.2 or more and 4.5 or less, or still more preferably 1.4 or more and 4.0 or less.

When the above ratio [Ti/Si] falls within the above range, good dispersing performance of the magnetic iron oxide in each toner particle can be easily attained, and the charging relaxation of the toner can be easily suppressed. At the same time, it becomes easy to prevent a reduction in density of an image output with the toner when the toner is used again after having been left to stand for a certain time period without being used.

When a photograph of the magnetic iron oxide used in the toner of the present invention taken with a transmission electron microscope is observed, it is preferred that the particles of the magnetic iron oxide be mainly formed of spherical particles each formed of a curved surface having no smooth surface, and be nearly free of octahedral particles.

The magnetic iron oxide used in the toner of the present invention has a number-average particle diameter based on a measurement method to be described later of preferably 0.05 to 0.50 μm, more preferably 0.08 to 0.40 μm, or still more preferably 0.10 to 0.30 μm. Setting the number-average particle diameter within the above range can additionally improve: the dispersing performance of the magnetic iron oxide in the binder resin of which each toner particle is formed; and the charging uniformity of the toner.

The magnetic iron oxide used in the toner of the present invention has a BET specific surface area based on a measurement method to be described later of preferably 5.0 $m^2/g$ or more and 15.0 $m^2/g$ or less, or more preferably 6.0 $m^2/g$ or more and 13.0 $m^2/g$ or less. Setting the BET specific surface area within the above range improves the ease with which the moisture absorption of the magnetic iron oxide that affects the charging performance of the toner is optimized.

The magnetic iron oxide used in the toner of the present invention has the following magnetic characteristics: in a magnetic field of 795.8 kA/m, the magnetic iron oxide has a saturation magnetization of preferably 10.0 to 200.0 $Am^2/kg$, or more preferably 60.0 to 100.0 $Am^2/kg$, a residual magnetization of preferably 1.0 to 100.0 $Am^2/kg$, or more preferably 2.0 to 20.0 $Am^2/kg$, and a coercive force of preferably 1.0 to 30.0 kA/m, or more preferably 2.0 to 15.0 kA/m. When the magnetic iron oxide has such magnetic characteristics, the toner can obtain such good developing performance that a balance between the density of an image formed with the toner and fogging is established.

The content of the above magnetic iron oxide in the toner of the present invention is preferably 50 to 150 parts by mass, or more preferably 60 to 120 parts by mass with respect to 100 parts by mass of the binder resin. When the content of the magnetic iron oxide is smaller than 50 parts by mass with respect to 100 parts by mass of the binder resin, the following tendency arises: fogging or toner scattering to the periphery of a character is apt to be worse. On the other hand, when the content of the magnetic iron oxide is larger than 150 parts by mass with respect to 100 parts by mass of the binder resin, the toner is apt to fly from the developing sleeve insufficiently, and the insufficiency is apt to be responsible for a reduction in density of an image formed with the toner.

Methods of measuring data on various physical properties in the present invention are detailed below.

(I) Method of Determining an Al Component Amount or Si Component Amount Eluted when the Above Magnetic Iron Oxide is Loaded into an Alkaline Aqueous Solution and the Si Component in the Magnetic Iron Oxide is Eluted with the Alkaline Aqueous Solution <1> Preparation of Sample First, 0.9 g of the magnetic iron oxide is weighed and loaded into a beaker made of methylpentene. Next, 25 ml of a 1-mol/L solution of NaOH are weighed and charged into the beaker. A rotor is loaded into the beaker, and the beaker is capped. The liquid in the beaker is heated and stirred on a hot stirrer for 4 hours (at a liquid temperature of 70° C.). After that, the liquid is left standing to cool. After the cooling, the entire magnetic iron oxide including the magnetic iron oxide adhering to the rotor is flown into a measuring cylinder with pure water. After the amount of the liquid has been adjusted to 125 ml with pure water, the liquid is transferred to the beaker and sufficiently stirred. After that, the beaker is left at rest on a magnet, and the magnetic iron oxide is sedimented until the supernatant becomes transparent. After the sedimentation, the supernatant is filtrated, and the filtrate is obtained.

<2> Measurement Method

The resultant filtrate is sprayed into the inductively coupled plasma of an ICP emission spectrometer (trade name: ICPS2000, manufacturer: Shimadzu Corporation), and its emission intensities at wavelengths of 288.16 nm (Si) and 396.15 nm (Al) are measured. The measured values are compared with the emission intensities of calibration curve liquids having known concentrations so that an Al element concentration (mg/L) and Si element concentration (mg/L) in the filtrate may be determined.

<3> Method of Preparing Calibration Curve Liquids Described Above

First, 4 g of NaOH, the Si component, and the Al component are added to a 100-mL polymer measuring flask. Then, the volume of the mixture containing them is set at a constant value of 100 mL with ion-exchanged water so that several calibration curve liquids each having an Si element concentration of the Si component in the range of 0 to 50 mg/L, and an Al element concentration of the Al component in the range of 0 to 40 mg/L.

<4> Calculation Equation

The Al component amount (in terms of the Al element: [mass %]) or Si component amount (in terms of the Si element: [mass %]) eluted when the Al component or Si component in the magnetic iron oxide is eluted with the above alkaline aqueous solution is calculated from the following equation:

$$\text{Al component amount(in terms of Al element:[mass \%])or Si component amount(in terms of Si element:[mass \%])}=(L\times 0.125)/(S\times 1{,}000)\times 100 \quad \text{(Equation)}$$

where L represents the concentration (mg/L) of each element obtained from the ICP measured value for the element, and S represents the mass of the sample, i.e., 0.9 (g).

(II) Method of Determining Amount of Each Element in Solution with Fe Element Dissolution Ratio of 10 Mass %.

<1> Preparation of Sample

The magnetic iron oxide sedimented in the beaker after the completion of the preparation of the sample described in the subsection [<1> Preparation of sample] of the above section (I), that is, the magnetic iron oxide after the Al component or Si component in the magnetic iron oxide has been eluted with the alkaline aqueous solution is collected and dried. Then, 25 g of the resultant dried product of the magnetic iron oxide are weighed and loaded into a 5-L glass beaker.

Next, 5 L of a 0.5-mol/L solution of $H_2SO_4$ are added to the beaker, and the temperature of the mixture is gradually increased from room temperature to 80° C. in a water bath while the mixture is stirred. Then, the magnetic iron oxide is gradually dissolved from its surface so that a solution may be obtained. Here, particularly when an Fe element amount in a solution in which the magnetic iron oxide is completely dissolved is defined as a total Fe element amount, a solution prepared by dissolving the magnetic iron oxide until 10 mass % of the total Fe element amount is present in the solution (referred to as "solution with an Fe element dissolution ratio of 10 mass %") is obtained. Then, 25 ml of the resultant solution (slurry) with an Fe element dissolution ratio of 10 mass % are collected. The collected slurry is filtrated with a 0.1-μm membrane filter, and the filtrate is obtained.

<2> Measurement Method

The resultant filtrate is sprayed into the inductively coupled plasma of an ICP emission spectrometer (trade name: ICPS2000, manufacturer: Shimadzu Corporation), and its emission intensities at wavelengths of 288.16 nm (Si), 396.15 nm (Al), 334.94 nm (Ti), and 259.94 nm (Fe) are measured. The measured values are compared with the emission intensities of calibration curve liquids having known concentrations so that an Si element concentration (mg/L), Ti element concentration (mg/L), Al element concentration (mg/L) and Fe element concentration (mg/L) in the filtrate may be determined.

<3> Method of Preparing Calibration Curve Liquids Described Above

First, 51 g of $H_2SO_4$, the Fe component, the Si component, the Al component, and the Ti component are added to a 1,000-mL polymer measuring flask. Then, the volume of the mixture containing them is set at a constant value of 1,000 mL with ion-exchanged water so that several calibration curve liquids each having an Fe element concentration of the Fe component in the range of 100 to 4,000 mg/L, an Si element concentration of the Si component in the range of 0 to 150 mg/L, an Al element concentration of the Al component in the range of 0 to 40 mg/L, and a Ti element concentration of the Ti component in the range of 0 to 30 mg/L may be prepared.

<4> Calculation Equation

The Si component amount (in terms of the Si element: [mass %]), Ti component amount (in terms of the Ti element: [mass %]), Al component amount (in terms of the Al element: [mass %]), or Fe component amount (in terms of the Fe element: [mass %]) in the above solution with an Fe element dissolution ratio of 10 mass % is calculated from the following equation:

$$\text{Si component amount(in terms of Si element:[mass \%]), Ti component amount(in terms of Ti element:[mass \%]), Al component amount(in terms of Al element:[mass \%]), or Fe component amount(in terms of Fe element:[mass \%])}=(L\times 5)/(S\times 1{,}000)\times 100 \quad \text{(Equation)}$$

where L represents the concentration (mg/L) of each element obtained from the ICP measured value for the element, and S represents the mass of the sample, i.e., 25 (g).

(III) Method of Determining Total Si Component Amount (in Terms of Si Element: [mass %]), total Ti Component Amount (in Terms of Ti Element: [mass %]), or Total Al Component Amount (in Terms of Al Element: [mass %]) in Magnetic Iron Oxide <1> Preparation of Sample First, 1.00 g of the magnetic iron oxide is weighed and loaded into a 100-mL Teflon beaker. Next, 10 mL of water and 16 mL of concentrated hydrochloric acid are added to the beaker, and then the mixture is heated so that the magnetic iron oxide may be completely dissolved. After the solution has been cooled, 4 mL of hydrofluoric acid (1+1) are added to the solution, and the mixture is left to stand for 20 minutes. Next, the resultant solution is transferred to a 100-mL polymer measuring flask, and 1 mL of a surfactant (trade name: Triton X [10 g/L]) is added to the solution. Then, the mixture is diluted with pure water so as to have a volume of 100 mL.

<2> Measurement Method

The sample solution prepared as described above is sprayed into the inductively coupled plasma of an ICP emission spectrometer (trade name: ICPS2000, manufacturer: Shimadzu Corporation), and its emission intensities at wavelengths of 288.16 nm (Si), 396.15 nm (Al), and 334.94 nm (Ti) are measured. The measured values are compared with the emission intensities of calibration curve liquids having known concentrations so that an Si element concentration (mg/L), Ti element concentration (mg/L), and Al element concentration (mg/L) in the sample solution may be determined.

<3> Method of Preparing Calibration Curve Liquids Described Above

First, 16 mL of HCl, 4 mL of HF (1+1), 1 mL of a surfactant (1% Triton X), 650 mg of Fe, the Si component, the Al component, and the Ti component are added to a 1,000-mL polymer measuring flask. Then, the volume of the mixture containing them is set at a constant value of 1,000 mL with ion-exchanged water so that several calibration curve liquids each having an Si element concentration of the Si component, an Al element concentration of the Al component, and a Ti element concentration of the Ti component each in the range of 0 to 200 mg/L may be prepared.

<4> Calculation Equation

The total Si component amount (in terms of the Si element: [mass %]), total Ti component amount (in terms of the Ti element: [mass %]), or total Al component amount (in terms of the Al element: [mass %]) in the magnetic iron oxide is calculated from the following equation:

total Si component amount(in terms of Si element: [mass %]), total Ti component amount(in terms of Ti element:[mass %]), or total Al component amount(in terms of Al element:[mass %])=$(L\times 1.1)/(S\times 1{,}000)\times 100$ (Equation)

where L represents the concentration (mg/L) of each element obtained from the ICP measured value for the element, and S represents the mass of the sample, i.e., 1.00 (g).

The (total) Ti component amount (in terms of the Ti element: [mass %]), or (total) Al component amount (in terms of the Al element: [mass %]) of the magnetic iron oxide used in the present invention is calculated by the method described in the above section (III).

The ratio (%) used in the present invention of the Al component amount eluted when the magnetic iron oxide is loaded into an alkaline aqueous solution and the Al component in the magnetic iron oxide is eluted with the alkaline aqueous solution to the total Al component amount in the magnetic iron oxide, or the ratio (%) used in the present invention of the Si component amount eluted when the magnetic iron oxide is loaded into the alkaline aqueous solution and the Si component in the magnetic iron oxide is eluted with the alkaline aqueous solution to the total Si component amount in the magnetic iron oxide is calculated from the results of the above sections (I) and (III).

When the magnetic iron oxide after the Al component in the magnetic iron oxide has been eluted with the alkaline aqueous solution is further dissolved in an acidic aqueous solution so that a solution may be obtained, and an Fe element amount in a solution in which the magnetic iron oxide is completely dissolved is defined as a total Fe element amount, the ratio (%) used in the present invention of the sum of the Al component amount in a solution prepared by dissolving the magnetic iron oxide until 10 mass % of the total Fe element amount is present in the solution (solution with an Fe element dissolution ratio of 10 mass %), and the Al component amount eluted when the magnetic iron oxide is loaded into the alkaline aqueous solution and the Al component in the magnetic iron oxide is eluted with the alkaline aqueous solution to the total Al component amount in the magnetic iron oxide is calculated from the results of the above sections (I), (II), and (III).

The ratio (Ti component amount in terms of Ti element/Al component amount in terms of Al element) used in the present invention of the Ti component amount in terms of the Ti element in the above solution with an Fe element dissolution ratio of 10 mass % to the Al component amount in terms of the Al element in the solution, or the ratio (Ti component amount in terms of Ti element/Si component amount in terms of Si element) used in the present invention of the Ti component amount in terms of the Ti element in the above solution with an Fe element dissolution ratio of 10 mass % to the Si component amount in terms of the Si element in the solution is calculated from the results of the above section (II).

(IV) Method of Measuring Number-Average Particle Diameter of Magnetic Iron Oxide The magnetic iron oxide is photographed with a transmission electron microscope at a magnification of 30,000. The Feret's diameters of 100 particles randomly selected from the particles of the magnetic iron oxide in the photograph are measured, and the average of the measured values is defined as the number-average particle diameter.

(V) Method of Measuring Specific Surface Area of Magnetic Iron Oxide

The specific surface area of the sample is calculated by employing a BET multipoint method while causing a nitrogen gas to adsorb to the surface of the sample with a specific surface area-measuring apparatus AUTOSORB 1 (manufactured by Yuasa Ionics Inc.).

(VI) Methods of Measuring Magnetic Characteristics of Magnetic Iron Oxide

Measurement is performed with a vibrating sample magnetometer (VSM-3S-15, manufactured by TOEI INDUSTRY CO., LTD.) in an external magnetic field of 795.8 kA/m.

(VII) Method of Measuring Dielectric Loss Tangent of Each of Toner and Binder Resin After the following ARES has been calibrated with a 4284A Precision LCR Meter (manufactured by Hewlett-Packard Company) at frequencies of 1 kHz and 1 MHz, the dielectric loss tangent ($\tan\delta=\epsilon''/\epsilon'$) of a sample is calculated from a measured value for the complex dielectric constant of the sample at a frequency of 10 kHz.

First, 0.7 g of a sample (the toner or the binder resin) is weighed, and is then molded into a disk-like measurement sample having a diameter of 25 mm and a thickness of 1 mm or less (or preferably 0.5 to 0.9 mm) under a load of 39,200 kPa (400 kg/cm$^2$) for 2 minutes. The measurement sample is mounted on an ARES (manufactured by Rheometric Scientific F.E. Ltd.) mounted with a dielectric constant-measuring jig (electrode) having a diameter of 25 mm, and is then heated to a temperature of 130° C. so as to be molten and fixed. After that, the sample is cooled to a temperature of 25° C., and is then heated to 150° C. at a rate of temperature increase of 2° C./min under a load of 0.49N (50 g) at a constant frequency of 10 kHz while measured values for the complex dielectric constants of the sample are taken every fifteen seconds. Then, a measured value for the complex dielectric constant at 140° C. is recorded.

A method of producing the magnetic iron oxide used in the present invention is exemplified. However, the method is not limited to the following production method.

(First Step)

An aqueous solution of ferrous sulfate, sodium silicate, sodium hydroxide, and water are mixed so that a mixed solution may be prepared. Air is blown into the mixed solution while the temperature and pH of the mixed solution are maintained at 90° C. and 6 to 9, respectively. Then, ferrous hydroxide produced in the solution is subjected to wet oxidation. The formation of the central region of a magnetite particle produced when 70 to 90% of the initial amount of the ferrous hydroxide is consumed is observed.

(Second Step)

The rate at which the oxidation reaction proceeds is examined by examining the concentration of unreacted ferrous hydroxide in the solution during the performance of the first step so that the time point at which 70 to 90% of the initial amount of the above ferrous hydroxide is consumed may be identified. At the identified time point, an aqueous solution of ferrous sulfate having the same concentration as that used in the first step, titanyl sulfate, and aluminum sulfate are added to the solution, and further, water is added to adjust the amount of the solution. Sodium hydroxide is added to the solution to adjust the pH of the solution to 9 to 12. Sodium silicate added in the first step remains in the solution. The wet oxidation is advanced by blowing air into the solution at a liquid temperature of 90° C. so that the intermediate region of the magnetite particle may be produced.

(Third Step)

During the performance of the second step, the blowing of air is stopped when 95 to 99% of unreacted ferrous hydroxide in the solution is consumed. Then, sodium silicate and aluminum sulfate are added to the solution. In addition, dilute sulfuric acid is added to adjust the pH of the solution to 5 to 9.

(Fourth Step)

Magnetite particles thus obtained are washed, filtrated, dried, and pulverized by ordinary methods. Thus, the magnetic iron oxide used in the present invention is obtained.

It should be noted that the above characteristics can be imparted to the magnetic iron oxide used in the present invention particularly by the following procedure: <1> a shift to the second step is performed when 70 to 90% of the initial amount of ferrous hydroxide is consumed in the first step, <2> titanyl sulfate is added in the second step, and the amounts of titanyl sulfate and aluminum sulfate at that time are appropriately adjusted and <3> the pH in the second step is adjusted to 9 to 12, and further, <4> a shift to the third step is performed when 95 to 99% of ferrous hydroxide is consumed, and <5> the addition amounts of sodium silicate and aluminum sulfate in the third step are appropriately adjusted.

The toner of the present invention may be positively chargeable, or may be negatively chargeable; the toner is preferably negatively chargeable because the binder resin itself has high negative charging performance. However, the toner particles used in the toner of the present invention each preferably contain a polymer A having a sulfonic group, a sulfonate group, or a sulfonic acid ester group (which may hereinafter be referred to as "polymer A") in order that the objects of the present invention may be achieved.

At a high temperature, the dielectric loss tangent of the toner increases owing to the state of dispersion of the magnetic iron oxide and the influence of any other material, so the charging relaxation of the toner is apt to occur in some cases. However, the incorporation of the above polymer A improves the ease with which the dielectric loss tangent of the toner at a high temperature is controlled within the range of the present invention, though the reason for the foregoing is unclear.

The incorporation of the above polymer A as a charge control resin alone into the toner tends to foment excessive charging of the toner depending on an environment or circumstance under which the toner is used. The tendency is apt to be remarkable particularly in a developing device adopting an elastic blade that has been adopted in recent laser beam printers. However, the inventors of the present invention have found the following: when the above polymer A and the above magnetic iron oxide are used together in the present invention, excessive charging of the toner is suppressed, so the dielectric loss tangent of the toner can be properly controlled.

Further, it is more preferred in the present invention that the toner particles used in the toner of the present invention each contain the above polymer A and a metal compound B of an aromatic oxycarboxylic acid or a derivative of the acid (which may hereinafter be referred to as "compound B") together. In this case, the ease with which the dielectric loss tangent of the toner is controlled is additionally improved, and the excessive charging of the toner caused by the addition of the above polymer A can be effectively suppressed, so compatibility between the charging performance of the toner and the developing performance of the toner such as a high density or reduced fogging can be easily attained.

The above compound B interacts with a carboxyl group of the binder resin in the melt kneading step of the production of the toner particles, that is, performs one kind of a complex formation reaction, which may be a ligand exchange reaction to form a crosslinked structure in the binder resin of each toner particle. As a result, a moderate shear is applied in the melt kneading step, and the ease with which the polymer A is finely dispersed in each toner particle is improved, so an effect of the addition of the polymer A can be exerted in a better fashion.

Further, it is still more preferred in the present invention that the toner particles used in the toner of the present invention each contain the above polymer A, the above compound B, and an azo-based iron compound C (which may hereinafter be referred to as "compound C") together. In this case, the ease with which the dielectric loss tangent of the toner is controlled is additionally improved, and the excessive charging of the toner caused by the addition of the above polymer A can be effectively suppressed, so compatibility between the charging performance of the toner and the developing performance of the toner such as a high density or reduced fogging can be easily attained.

Although the reason why incorporating the three components together exerts the above effects is unclear, the reason probably is as described below.

The polymer A tends to have a higher ability to provide the toner with a charge quantity than those of the compounds B and C. The inventors of the present invention think that the compound C, when used in combination with the polymer A, is coexistent around the polymer A to show such a function as to suppress the excessive charging of the toner caused by the polymer A.

Meanwhile, as described above, the compound B forms a crosslinked structure in the melt kneading step of the production of the toner particles, so a moderate shear is applied in the melt kneading step. As a result, the ease with which the compound C is finely dispersed around the polymer A is improved. In addition, the ease with which the polymer A and the compound C are uniformly dispersed in the entirety of each toner particle is improved. The high uniform dispersing performance of the polymer A and the compound C is preferably achieved in order that an effect targeted by the present invention may be exerted.

A copolymer of a styrene-based monomer and an acrylic monomer, and a sulfonic acid-containing acrylamide-based monomer (sulfonic group-containing copolymer) is particularly preferably used as the above polymer A in order that the effect of the present invention may be exerted to the maximum extent.

The styrene-based monomer and the acrylic monomer used in the polymer A are appropriately selected from known vinyl-based monomers used for producing vinyl-based copolymers. A preferable combination of the monomers is, for example, a combination of styrene and an acrylate or of styrene and a methacrylate.

Examples of the sulfonic acid-containing acrylamide-based monomer to be used in the polymer A include 2-acrylamidepropanesulfonic acid, 2-acrylamide-n-butanesulfonic acid, 2-acrylamide-n-hexanesulfonic acid, 2-acrylamide-n-octanesulfonic acid, 2-acrylamide-n-dodecanesulfonic acid, 2-acrylamide-n-tetradecanesulfonic acid, 2-acrylamide-2-methylpropanesulfonic acid, 2-acrylamide-2-methylphenylethanesulfonic acid, 2-acrylamide-2-(4-chlorophenyl) propanesulfonic acid, 2-acrylamide-2-carboxymethylpropanesulfonic acid, 2-acrylamide-2-(2-pyridine)propanesulfonic acid, 2-acrylamide-1-methylpropanesulfonic acid, 3-acrylamide-3-methylbutanesulfonic acid, 2-methacrylamide-n-decanesulfonic acid, and 2-methacrylamide-n-tetradecanesulfonic acid. Of those, 2-acrylamide-2-methylpropanesulfonic acid is preferable from the viewpoint of charging performance.

A polymerization initiator used upon synthesis of the polymer A is appropriately selected from initiators used upon production of the above vinyl-based copolymers; a peroxide initiator is preferably used.

In addition, a method of synthesizing the polymer A is not particularly limited, and any one of the methods including solution polymerization, suspension polymerization, and bulk polymerization can be employed; solution polymerization involving copolymerizing monomers in an organic solvent containing a lower alcohol is preferable.

A copolymerization mass ratio between the styrene-based monomer and the acrylic monomer, and the sulfonic acid-containing acrylamide-based monomer "styrene-based monomer and acrylic monomer:sulfonic acid-containing acrylamide-based monomer" is preferably 98:2 to 80:20. When the ratio of the sulfonic acid-containing acrylamide-based monomer is smaller than 2 mass %, the toner may be unable to obtain a sufficient charging characteristic. On the other hand, when the ratio is larger than 20 mass %, the toner may show reduced environmental stability.

The polymer A has an acid value (mgKOH/g) of preferably 3.0 to 80.0, more preferably 5.0 to 50.0, or still more preferably 10.0 to 40.0. When the acid value of the polymer A is less than 3.0, the toner tends to have difficulty in obtaining a charge control action, and its environmental characteristic tends to reduce. On the other hand, when the acid value of the polymer A exceeds 80.0, the toner is susceptible to moisture at a high temperature and a high humidity, and its environmental stability tends to reduce.

The polymer A has a weight-average molecular weight (Mw) of preferably 2,000 to 200,000, more preferably 17,000 to 100,000, or still more preferably 27,000 to 50,000. When the weight-average molecular weight (Mw) is less than 2,000, the polymer A is compatible with, or finely dispersed in, the binder resin, so the following tendency arises: an influence of the polymer on the charging characteristic of the toner is not large, and the flowability and transferring performance of the toner are reduced. On the other hand, when the weight-average molecular weight (Mw) exceeds 200,000, a phase separation between the polymer A and the binder resin is apt to occur, so the environmental stability of the toner tends to reduce.

The polymer A has a glass transition point (Tg) of preferably 30° C. to 120° C., more preferably 50° C. to 100° C., or still more preferably 70° C. to 95° C.

When the glass transition point (Tg) of the polymer A is lower than 30° C., the flowability, storage stability, and transferring performance of the toner tend to reduce. On the other hand, when the glass transition point (Tg) exceeds 120° C., fixing performance upon output of an image having a high toner print percentage tends to reduce.

In the present invention, the "molecular weight and molecular weight distribution by GPC" of each of the polymer A and the binder resin described above are measured by the following methods. It should be noted that an arbitrary method can be employed without any particular limitation for extracting the polymer A from the toner particles.

First, the sample is dissolved in tetrahydrofuran (THF) at room temperature over 24 hours. Then, the resultant solution is filtrated through a solvent-resistant membrane filter "Maishori Disk" (manufactured by TOSOH CORPORATION) having a pore diameter of 0.2 μm, whereby a sample solution is obtained. It should be noted that the concentration of a component soluble in THF in the sample solution is adjusted to about 0.8 mass %. Measurement is performed by using the sample solution under the following conditions.

Apparatus: HLC8120 GPC (detector: RI) (manufactured by TOSOH CORPORATION)

Column: 7 consecutive columns of Shodex KF-801, 802, 803, 804, 805, 806, and 807 (manufactured by SHOWA DENKO Eluting solution: tetrahydrofuran (THF)

Flow rate: 1.0 ml/minute

Oven temperature: 40.0° C.

Sample injection amount: 0.10 ml

Upon calculation of the molecular weight of the sample, a molecular weight calibration curve prepared with a standard polystyrene resin (such as a product available under the trade name "TSK Standard Polystyrene F-850, F-450, F-288, F-128, F-80, F-40, F-20, F-10, F-4, F-2, F-1, A-5000, A-2500, A-1000, or A-500" manufactured by TOSOH CORPORATION) is used.

In the present invention, the "glass transition point" of each of the polymer A and the binder resin described above is measured with a differential scanning calorimeter "Q1000" (manufactured by TA Instruments) in conformity with ASTM D3418-82. The measurement is performed as follows: the temperature is increased and decreased once so that a prehistory may be acquired, and a DSC curve measured when the temperature of a sample is increased at a rate of temperature increase of 10° C./min after the acquisition is used. A change in specific heat is obtained in the temperature range of 40 to 100° C. in the temperature increase process. The point of intersection of a line passing through an intermediate point between baselines before and after the appearance of the change in specific heat in this case and the DSC curve is defined as the glass transition point (Tg) of each of the polymer A and the binder resin in the present invention.

In the present invention, the "acid value" of each of the polymer A and the binder resin described above is determined as described below.

An acid value is the amount (mg) of potassium hydroxide needed for neutralizing an acid in 1 g of a sample. The acid value, which is measured in conformity with JIS K 0070-1992, is specifically measured in accordance with the following procedure.

(1) Preparation of Sample

First, 1.0 g of phenolphthalein is dissolved in 90 ml of ethyl alcohol (95 vol %), and ion-exchanged water is added so that the volume of the mixture becomes 100 ml. Thus, a phenolphthalein solution is obtained.

Then, 7 g of reagent grade potassium hydroxide are dissolved in 5 ml of water, and ethyl alcohol (95 vol %) is added so that the volume of the mixture becomes 1 l. The mixture is charged into an alkali-proof container so as to be out of contact with a carbon dioxide gas or the like, and is then left to stand for 3 days. After that, the mixture is filtrated so that a potassium hydroxide solution is obtained. The resultant potassium hydroxide solution is stored in the alkali-proof container. The factor of the potassium hydroxide solution is determined as follows: 25 ml of a 0.1-mol/l hydrochloric acid are collected in an Erlenmeyer flask, several drops of the phenolphthalein solution are added to the hydrochloric acid, the mixture is titrated with the potassium hydroxide solution, and the amount of the potassium hydroxide solution needed for the neutralization is used for the determination. The 0.1-mol/l hydrochloric acid used here is one produced in conformity with JIS K 8001-1998.

(2) Operations (A) Real Test

First, 2.0 g of a pulverized sample (the polymer A or the binder resin) are weighed in a 200-ml Erlenmeyer flask, and 100 ml of a mixed solution containing toluene and ethanol at a ratio of 2:1 are added to dissolve the sample over 5 hours. Next, several drops of the phenolphthalein solution are added as an indicator to the solution, and the mixture is titrated with the potassium hydroxide solution. It should be noted that the amount of the solution in which the indicator maintains its incarnadine color for about 30 seconds is defined as the end-point of the titration.

(B) Blank Test

The same titration as the above operation is performed except that no sample is used (that is, only the mixed solution containing toluene and ethanol at a ratio of 2:1 is used).

(3) The acid value is calculated by substituting the obtained results into the following equation:

$$A=[(C-B)\times f\times 5.61]/S$$

where A represents the acid value (mgKOH/g), B represents the addition amount (ml) of the potassium hydroxide solution in the blank test, C represents the addition amount (ml) of the potassium hydroxide solution in the real test, f represents the factor of the potassium hydroxide solution, and S represents the mass (g) of the sample.

In the present invention, the above polymer A, which can be used as it is, is preferably pulverized by a known pulverizing method before use so that its particle diameters may be uniformized. This is because the polymer shows improved compatibility with, and improved dispersing performance in, any other material. The pulverized particles each have a diameter of preferably 300 μm or less, or more preferably 150 μm or less because the polymer can be easily dispersed in any other material in a favorable fashion.

The above polymer A is incorporated in an amount of preferably 0.80 to 6.0 parts by mass, more preferably 0.90 to 4.5 parts by mass, or still more preferably 1.0 to 4.0 parts by mass per 100 parts by mass of the binder resin.

As the above compound C, the azo-based iron compound represented by the following general formula is preferable for being capable of a imparting high charge amount with stability:

[Chem 1]

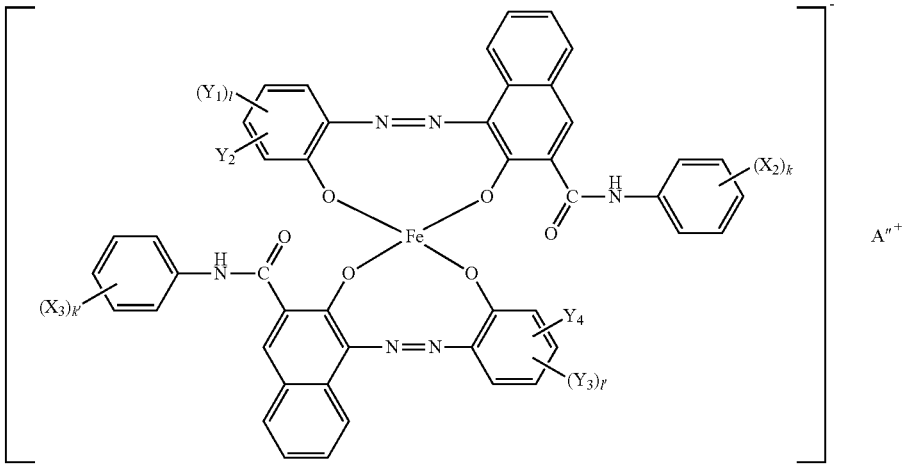

where: $X_2$ and $X_3$ each represent a hydrogen atom, a lower alkyl group, a lower alkoxy group, a nitro group, or a halogen atom; and k and k' each represent an integer of 1 to 3; $Y_1$ and $Y_3$ each represent a hydrogen atom, an alkyl group having 1 to 18 carbon atoms, an alkenyl group having 2 to 18 carbon atoms, a sulfonamide group, a mesyl group, a sulfonic group, a carboxylate group, a hydroxy group, an alkoxy group having 1 to 18 carbon atoms, an acetylamino group, a benzoyl group, an amino group, or a halogen atom; l and l' each represent an integer of 1 to 3; $Y_2$ and $Y_4$ each represent a hydrogen atom or a nitro group; provided that the above $X_2$ and $X_3$, k and k', $Y_1$ and $Y_3$, l and l', and $Y_2$ and $Y_4$ may be the same or different from each other; and $A''^{+}$ represents an ammonium ion, a sodium ion, a potassium ion, a hydrogen ion, or a mixed ion of two or more of them.

In the above formula, $A''^{+}$ represents an ammonium ion, a sodium ion, a potassium ion, a hydrogen ion, or a mixed ion of two or more of them; in the present invention, $A''^{+}$ preferably represents a sodium ion in terms of the suppression of the excessive charging of the toner caused by the polymer A, though the reason for the foregoing is unclear.

Next, specific examples of the azo-based iron compound are shown.

[Chem 2]

Azo-based iron compund (1)

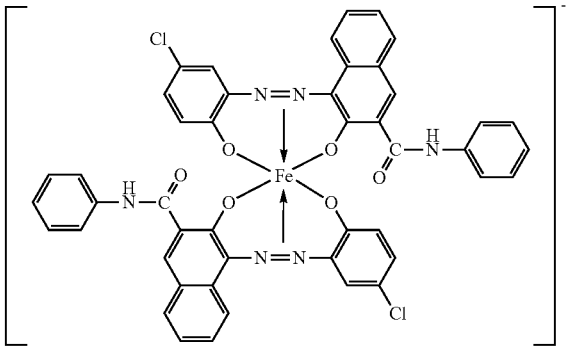

$NH_4^+$ (and $H^+$, $Na^+$, $K^+$, or a mixed ion of two or more of them)

Azo-based iron compound (2)

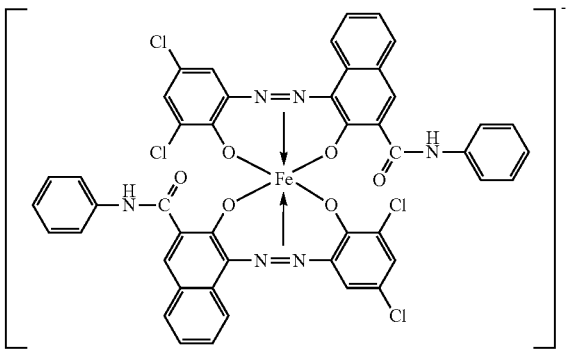

$NH_4^+$ (and $H^+$, $Na^+$, $K^+$, or a mixed ion of two or more of them)

Azo-based iron compound (3)

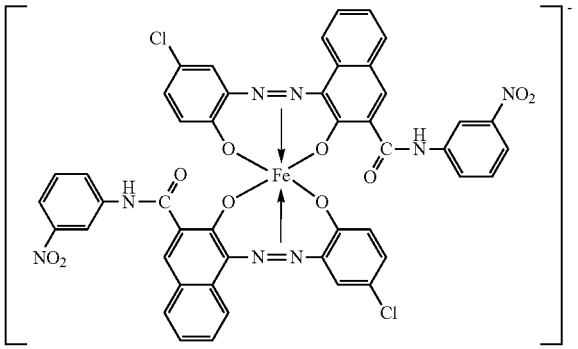

$NH_4^+$ (and $H^+$, $Na^+$, $K^+$, or a mixed ion of two or more of them)

-continued

[Chem 3]

Azo-based iron compound (4)

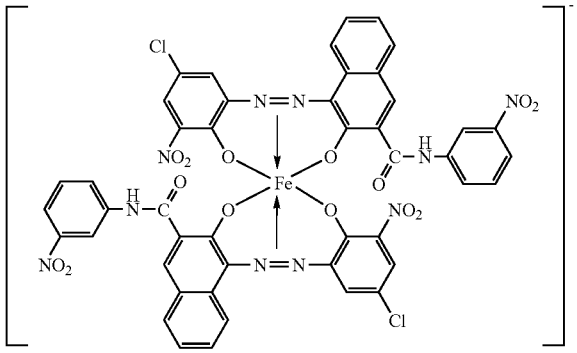

$NH_4^+$ (and $H^+$, $Na^+$, $K^+$, or a mixed ion of two or more of them)

Azo-based iron compound (5)

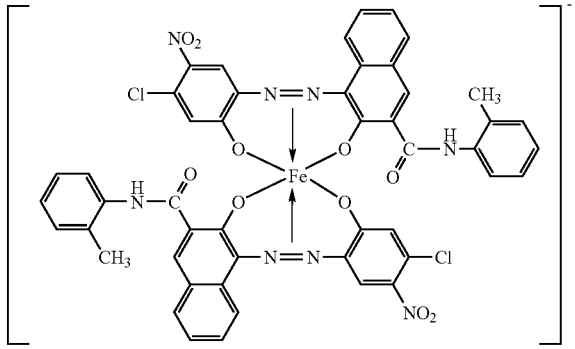

$NH_4^+$ (and $H^+$, $Na^+$, $K^+$, or a mixed ion of two or more of them)

Azo-based iron compound (6)

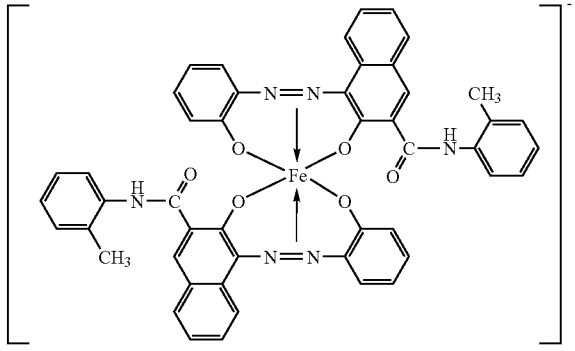

$NH_4^+$ (and $H^+$, $Na^+$, $K^+$, or a mixed ion of two or more of them)

-continued

[Chem 4]

Azo-based iron compound (7)

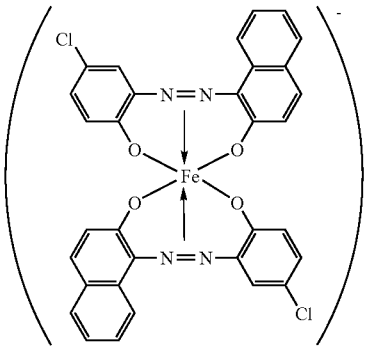

$NH_4^+$ (and $H^+$, $Na^+$, $K^+$, or a mixed ion of two or more of them)

Of those, an azo-based iron compound represented by the above formula (1) is preferable in terms of a suppressing effect on the excessive charging of the toner caused by the polymer A. The content of the azo-based iron compound (I) in the toner can be identified by using a Cl element as a target.

The above azo-based iron compound (compound C) is used in an amount of preferably 0.10 to 5.0 parts by mass, or more preferably 0.10 to 4.0 parts by mass with respect to 100 parts by mass of the binder resin.

The above compound B is, for example, the metal compound B of an aromatic oxycarboxylic acid or a derivative of the acid represented by the following general formula:

[Chem 5]

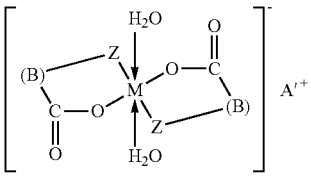

where M represents a coordination center metal selected from Cr, Co, Ni, Mn, Fe, Ti, Zr, Zn, Si, B, and Al, (B) represents

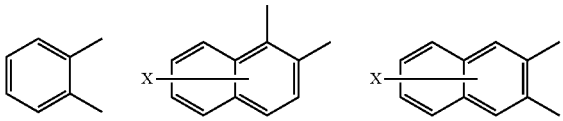

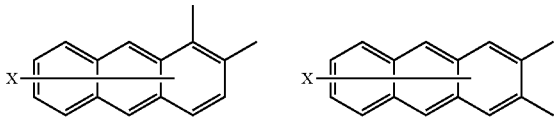

(each of which may have an alkyl group as a subtituent)

(where X represents a hydrogen atom, a halogen atom, or a nitro group), or

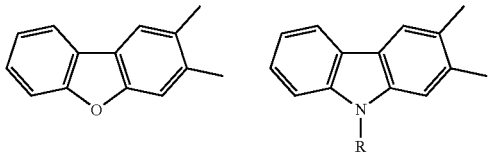

-continued

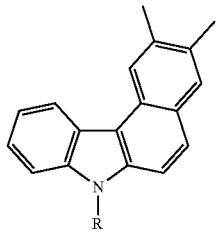

(where R represents a hydrogen atom, an alkyl group having 1 to 18 carbon atoms, or an alkenyl group having 2 to 18 carbon atoms), $A'^+$ represents a hydrogen ion, a sodium ion, a potassium ion, an ammonium ion, or aliphatic ammonium ion, and, Z represents

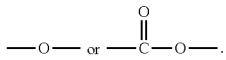

Next, specific examples of the hydroxycarboxylic acid metal compound are shown.

[Chem 6]

Al salicylate compound (1)

(9)

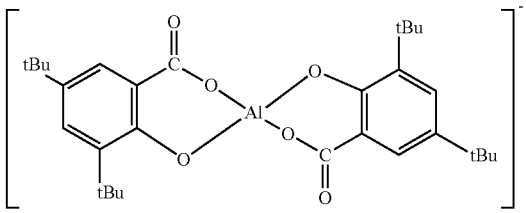

Zn salicylate compound (1)

(10)

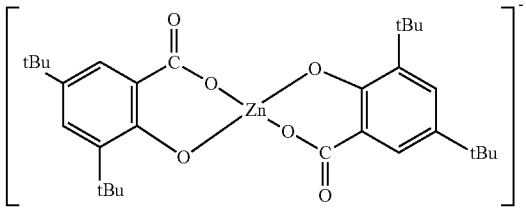

Cr salicylate compound (1)

(11)

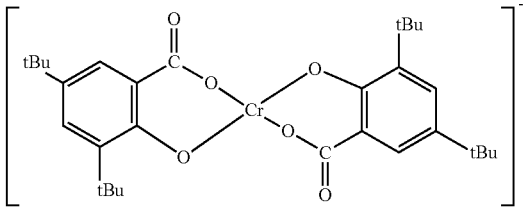

Zr salicylate compound (1)

-continued (12)

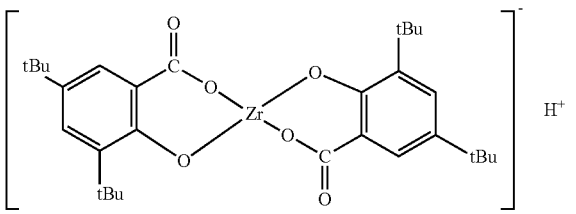

Of those, a metal compound using an Al element, Zn element, or Zr element as its center metal is preferable because of its high charge quantity; a metal compound using an Al element as its center metal is particularly preferable because the compound has such a relatively large charge quantity that the charging of each of the polymer A and the compound C described above is not inhibited.

The above compound B is used in an amount of preferably 0.10 to 2.0 parts by mass, or more preferably 0.15 to 1.5 parts by mass with respect to 100 parts by mass of the binder resin. The amount is particularly preferably 0.20 part by mass or more and less than 1.0 part by mass in terms of the formation of the crosslinked structure and uniform dispersing performance of the polymer A and the compound C.

It is particularly preferred that the toner particles used in the toner of the present invention each contain all of the polymer A, the compound B, and the compound C by the above reasons. When the toner particles each contain all of them, the content MA (parts by mass) of the polymer A with respect to 100 parts by mass of the binder resin, the content MB (parts by mass) of the compound B with respect to 100 parts by mass of the binder resin, and the content MC (parts by mass) of the compound C with respect to 100 parts by mass of the binder resin particularly preferably satisfy the following formulae (1) to (3).

$$8.0>MA/MB>1.5 \quad \text{Formula (1)}$$

(more preferably, 7.0>MA/MB>1.8, still more preferably, 6.0>MA/MB>2.0)

$$5.0>MA/MC>0.80 \quad \text{Formula (2)}$$

(more preferably, 4.5>MA/MB>0.90, still more preferably, 4.0>MA/MB>1.0)

$$MA>MC>MB \quad \text{Formula (3)}$$

Further preferably, the following formula (4) may be satisfied.

$$1.0\times10^{1}>MC/MB>1.2 \quad \text{Formula (4)}$$

(more preferably, 8.0>MA/MB>1.3, still more preferably, 6.0>MA/MB>1.4)

Such addition of the polymer A, the compound B, and the compound C that the above formulae (1) to (4) are satisfied improves the ease with which an effect intended by the present invention is obtained.

In addition, the MA, MB, and MC preferably satisfy the following formula (5) in terms of compatibility between the charging performance and fixing performance of the toner:

$$5.0>MA+MB+MC>1.0. \quad \text{Formula (5)}$$

For MA+MB+MC≧5.0, the total amount of the polymer A, the compound B, and the compound C with respect to the binder resin becomes excessive, which is apt to deteriorate the fixing performance of the toner. On the other hand, for MA+MB+MC≦1.0, the following tendency arises: the charge-providing performance of the components becomes insufficient, so the charging stability of the toner is apt to reduce.

As described above, in the present invention, the polymer A, the compound B, and the compound C are preferably incorporated together; the three components are particularly preferably incorporated so as to satisfy such specific relationship as described below.

That is, in element intensities obtained by fluorescent X-ray measurement for the toner, an intensity [Is] of a sulfur element, an intensity [Ia] of a Cl element, and an intensity [Ib] of an element that shows the highest intensity among an element group b (Al, Zn, and Zr) particularly preferably satisfy a specific relationship in order that the effect of the present invention may be exerted.

First, the contents of the polymer A and the compound C in the toner particles are preferably adjusted so that the intensity [Is] of a sulfur element and the intensity [Ia] of a Cl element in the element intensities obtained by the fluorescent X-ray measurement for the toner may satisfy the following formula (6):

$$0.10<Is/Ia<0.80. \quad \text{Formula (6)}$$

The intensities Is and Ia more preferably satisfy the relationship of 0.12<Is/Ia<0.70, or still more preferably satisfy the relationship of 0.15<Is/Ia<0.60 (provided that the Is and Ia are each a value obtained by subtracting an intensity derived from a colorant in the toner from an intensity in the entire toner).

The case where the ratio Is/Ia falls within the above range means that the polymer A and the compound C are each incorporated in an amount proper for the acquisition of the effect of the present invention, so an effect of the addition of each of the polymer A and the compound C easily becomes clear.

In addition, the contents of the polymer A and the compound B in the toner particles are preferably adjusted so that the intensity [Is] of a sulfur element and the intensity [Ib] of an element that shows the highest intensity among an element group b (Al, Zn, and Zr) in the element intensities obtained by the fluorescent X-ray measurement for the toner may satisfy the following formula (7):

$$0.30<Is/Ib<1.0. \quad \text{Formula (7)}$$

The intensities Is and Ib more preferably satisfy the relationship of 0.35<Is/Ib<0.95, or still more preferably satisfy the relationship of 0.40<Is/Ib<0.90 (provided that the Is and Ib are each a value obtained by subtracting an intensity derived from a colorant in the toner from an intensity in the entire toner).

The case where the ratio Is/Ib falls within the above range means that the polymer A and the compound B are each incorporated in an amount proper for the acquisition of the effect of the present invention, so an effect of the addition of each of the polymer A and the compound B easily becomes clear. That is, the charge quantity distribution of the toner hardly widens because the formation of a large number of proper crosslinked structures by the sulfonic group, sulfonate group, or sulfonic acid ester group that affects the charge-providing performance of the components is achieved.

In addition, the intensities Is, Ia, and Ib preferably satisfy the following formula (8) in order that the effect of the present invention may be exerted to an additionally large extent:

$$2.0<(Is+Ia)/Ib<1.0\times10^{1}. \quad \text{Formula (8)}$$

When the ratio (Is+Ia)/Ib falls within the above range, a moderate shear is applied at the time of melt kneading in the production of the toner particles. As a result, the ease with which high uniform dispersing performance of the polymer A and the compound C is achieved is improved, and a crosslinked structure containing each of the polymer A and the compound C in a proper amount is formed. Accordingly, the charge quantity distribution of the toner hardly widens.

The fluorescent X-ray measurement for each element, which is in conformity with JIS K 0119-1969, is specifically as described below.

A combination of a wavelength-dispersive fluorescent X-ray analyzer "Axios" (manufactured by PANalytical) and a dedicated software "SuperQ ver. 4.0F" (manufactured by PANalytical) included with the analyzer for setting measurement conditions and analyzing measurement data is used as a measuring apparatus. It should be noted that Rh is used in an anode for an X-ray tube, and the measurement is performed in a vacuum atmosphere at a measurement diameter (collimator mask diameter) of 27 mm for a measurement time of 10 seconds. In addition, when a light element is subjected to the measurement, its intensity is detected with a proportional counter (PC); when a heavy element is subjected to the measurement, its intensity is detected with a scintillation counter (SC).

A pellet obtained by the following procedure is used as a measurement sample: about 4 g of the toner are loaded into a dedicated aluminum ring for pressing and leveled, and the resultant is pressurized with a tablet molding compressor "BRE-32" (manufactured by Maekawa Testing Machine Mfg. Co., LTD.) at 20 MPa for 60 seconds so as to be molded into the pellet having a thickness of about 2 mm and a diameter of about 39 mm. The measurement is performed under the above conditions, and an element is identified on the basis of the resultant X-ray peak position. Then, the concentration of the element is calculated from a counting rate (unit:cps) as the number of X-ray photons per unit time.

Because the magnetic iron oxide used in the present invention may also contain an element involved in any one of the fluorescent X-ray intensities Is, Ia, and Ib, the Is, Ia, and Ib are each a value obtained by subtracting an intensity derived from the magnetic iron oxide in the toner from an intensity in the entire toner.

It is preferred that the magnetic iron oxide single body used and the toner be separately subjected to fluorescent X-ray analysis and a difference in intensity between them be taken. Alternatively, for example, the Is, Ia, and Ib each obtained by subtracting the intensity derived from the magnetic iron oxide in the toner from the intensity in the entire toner can be made known by the following procedure: after the toner has been loaded into a solvent such as THF and left at rest overnight or longer, the magnetic iron oxide is separated with a magnet, and then a portion except the magnetic iron oxide is collected and subjected to fluorescent X-ray analysis.

The toner of the present invention is a toner including: toner particles each containing at least a binder resin, a wax, and a magnetic iron oxide; and inorganic fine particles.

Examples of the above binder resin include, but not particularly limited to, a vinyl-based resin, a polyester-based resin, an epoxy resin, and a polyurethane resin; a conventionally known resin can be used as the binder resin. Of those, a polyester resin or a vinyl-based resin is preferably incorporated from the viewpoint of compatibility between the charging performance and fixing performance of the toner; a resin having a polyester unit is particularly preferably used because the use is advantageous for the fixing performance.

The composition of the above polyester resin is as described below.

Examples of dihydric alcohol components include: ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and bisphenols represented by the following formula (A) and derivatives thereof; and diols represented by the following formula (B).

[Chem 7]

(A)

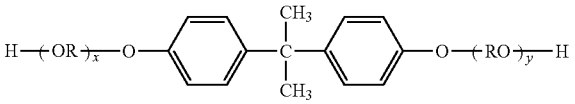

(In the formula, R denotes an ethylene group or a propylene group, x and y each denote an integer of 0 or more, and an average value of x+y is 0 to 10.)

[Chem 8]

(B)

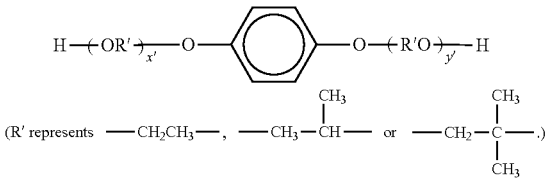

(In the formula, x' and y' each denote an integer of 0 or more, and an average value of x+y is 0 to 10.)

Examples of divalent acid components include dicarboxylic acids and derivatives thereof, for example, benzenedicarboxylic acids or anhydrides thereof or lower alkyl esters thereof such as phthalic acid, terephthalic acid, isophthalic acid, and phthalic anhydride; alkyldicarboxylic acids such as succinic acid, adipic acid, sebacic acid, and azelaic acid, or anhydrides thereof or lower alkyl esters thereof; alkenyl succinic acids or alkyl succinic acids, such as n-dodecenylsuccinic acid and n-dodecylsuccinic acid, or anhydrides thereof or lower alkyl esters thereof; and unsaturated dicarboxylic acids such as fumaric acid, maleic acid, citraconic acid, and itaconic acid, or anhydrides thereof or lower alkyl esters thereof.

In the present invention, the polyester resin is preferably a polyester obtained by the condensation polymerization of a carboxylic acid component containing 90 mol % or more of an aromatic carboxylic acid compound and an alcohol component in which 80 mol % or more of the molecules of the aromatic carboxylic acid compound are terephthalic acid and/or isophthalic acid in terms of an improvement in uniform dispersing performance of an internal additive such as the magnetic iron oxide or the wax, though the reason for the foregoing is unclear.

Further, it is preferable to use an alcohol component with 3 or more hydroxyl groups and an acid component with a valence of 3 or more which act as cross-linked components alone or in combination in terms of achieving a more uniform dispersing performance of an internal additive such as the magnetic iron oxide or the wax.

Examples of a polyhydric alcohol component with 3 or more hydroxyl groups include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanethiol, 2-methyl-1,2,4-butanetriol, trimethylolethane, trimethylolpropane, and 1,3,5-trihydroxybenzene.

Examples of a polycarboxylic acid component with 3 or more carboxyl groups include polycarboxylic acids and derivatives thereof such as trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, Empol trimer acid, and anhydrides thereof and lower alkyl esters thereof; and tetracarboxylic acids represented by the following formula (C), and anhydrides thereof and lower alkyl esters thereof.

[Chem 9]

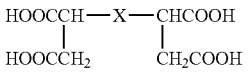

(C)

(In the formula, X denotes an alkylene group or an alkenylene group having 5 to 30 carbon atoms and having one or more side chain with 3 or more carbon atoms.)

The above alcohol component proportion is 40 to 60 mol %, or preferably 45 to 55 mol %. Also, the acid component proportion is 60 to 40 mol %, or preferably 55 to 45 mol %.

The above polyester resin is obtained by condensation polymerization which is generally well-known.

On the other hand, examples of vinyl-based monomers for producing the vinyl-based resin may include the following:

styrene; styrene derivatives such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; and acrylate or methacrylate derivatives such as acrylonitrile, methacrylonitrile, and acrylamide.

The examples further include: unsaturated dibasic acids such as maleic acid, citraconic acid, itaconic acid, an alkenylsuccinic acid, fumaric acid, and mesaconic acid; unsaturated dibasic acid anhydrides such as maleic anhydride, citraconic anhydride, itaconic anhydride, and an alkenylsuccinic anhydride; unsaturated dibasic acid half esters such as maleic acid methyl half ester, maleic acid ethyl half ester, maleic acid butyl half ester, citraconic acid methyl half ester, citraconic acid ethyl half ester, citraconic acid butyl half ester, itaconic acid methyl half ester, alkenylsuccinic acid methyl half ester, fumaric acid methyl half ester, and mesaconic acid methyl half ester; unsaturated dibasic acid esters such as dimethyl maleate and dimethyl fumarate; α,β-unsaturated acids such as acrylic acid, methacrylic acid, crotonic acid, and cinnamic acid; α,β-unsaturated acid anhydrides such as crotonic anhydride and cinnamic anhydride, and anhydrides of the α,β-unsaturated acids and lower fatty acids; and monomers each having a carboxyl group such as an alkenylmalonic acid, an alkenylglutaric acid, and an alkenyladipic acid, and anhydrides and monoesters of these acids.

The examples further include: acrylates or methacrylates such as 2-hydroxyethyl acrylate, 2-hydroxyethyl methacrylate, and 2-hydroxypropyl methacrylate; and monomers each having a hydroxy group such as 4-(1-hydroxy-1-methylbutyl)styrene and 4-(1-hydroxy-1-methylhexyl)styrene.

In the toner of the present invention, the vinyl-based resin of the binder resin may have a crosslinked structure in which its molecules are crosslinked with a crosslinking agent having two or more vinyl groups.

Examples of the crosslinking agent to be used in the case include: aromatic divinyl compounds such as divinylbenzene and divinylnaphthalene; diacrylate compounds bonded with an alkyl chain such as ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and those obtained by replacing the "acrylate" of each of the compounds with "methacrylate"; diacrylate compounds bonded with an alkyl chain containing an ether bond such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and those obtained by replacing the "acrylate" of each of the compounds with "methacrylate"; diacrylate compounds bonded with a chain containing an aromatic group and an ether bond such as polyoxyethylene (2)-2,2-bis(4-hydroxyphenyl)propane diacrylate, polyoxyethylene(4)-2,2-bis(4-hydroxyphenyl)propane diacrylate, and those obtained by replacing the "acrylate" of each of the compounds with "methacrylate"; and polyester-type diacrylate compounds, for example, trade name "MANDA", available from Nippon Kayaku Co., Ltd.

Further, examples of polyfunctional crosslinking agents include the following: pentaerythritol triacrylate, trimethylolethane triacrylate, trimethylolpropane triacrylate, tetramethylolmethane tetraacrylate, oligoester acrylate, and those obtained by replacing the "acrylate" of each of the compounds with "methacrylate"; and triallyl cyanurate and triallyl trimellitate.

These crosslinking agents can be used in an amount of preferably 0.01 to 10 parts by mass, more preferably 0.03 to 5 parts by mass with respect to 100 parts by mass of the other monomer components.

Of those crosslinking agents, for example, the aromatic divinyl compounds (especially divinylbenzene) and the diacrylate compounds each composed of two acrylates bonded to each other through a chain containing an aromatic group and an ether bond are each suitably used in terms of the fixing performance and offset resistance of the toner.

Further, examples of polymerization initiators used for producing the vinyl-based copolymer component include: 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)isobutyronitrile, 2,2'-azobis(2,4,4-trimethylpentane), 2-phenylazo-2,4-dimethyl-4-methoxyvaleronitrile, and 2,2'-azobis(2-methylpropane); ketone peroxides such as methyl ethyl ketone peroxide, acetylacetone peroxide, and cyclohexanone peroxide; and 2,2-bis(t-butylperoxy)butane, t-butyl hydroperoxide, cumene hydroperoxide, 1,1,3,3-tetramethylbutyl hydroperoxide, di-t-butyl peroxide, t-butylcumyl peroxide, dicumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-toluoyl peroxide, diisopropyl peroxydicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl) peroxycarbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butylperoxyisopropyl carbonate, di-t-butyl peroxyisophthalate, t-butyl peroxyallylcarbonate, t-amyl peroxy-2-ethylhexanoate, di-t-butyl peroxyhexahydroterephthalate, and di-t-butyl peroxyazelate.

The above binder resin has a glass transition point (Tg) of desirably 45 to 70° C., preferably 50 to 70° C., or more preferably 52 to 65° C. from the viewpoint of the ease with which compatibility between the low-temperature fixability and storage stability of the toner is achieved.

When the glass transition point (Tg) is lower than 45° C., the storage stability of the toner tends to be apt to reduce. On the other hand, when the glass transition point (Tg) is higher than 70° C., the low-temperature fixability tends to be apt to reduce.

In addition, the binder resin used in the present invention preferably has a certain acid value (mgKOH/g) in terms of the ease with which a crosslinked structure is produced when the above compound B is added and the charging stability of the toner; the acid value is more preferably 10.0 to 60.0 mgKOH/g, or still more preferably 15.0 to 40.0 mgKOH/g.

Further, when the dielectric loss tangent of the binder resin at 140° C. is less than $5.0\times10^{-3}$, the toner may be of such a constitution as to be originally hard to be provided with a charge quantity. In contrast, when the dielectric loss tangent is larger than 0.10, the charge quantity of the toner on paper tends to be apt to reduce, so the electrostatic offset or the tailing is apt to be remarkable.

In the present invention, the toner particles each contain a wax. Preferable examples of the wax include: hydrocarbon waxes such as low-molecular weight polyethylene, low-molecular weight polypropylene, a microcrystalline wax, and a paraffin wax due to easiness of dispersion and high releasing performance in the particles of the toner. However, a small amount of one or two or more kinds of wax may be used in combination where necessary. Specific examples of the wax used in combination include the following.

The examples include: oxides of aliphatic hydrocarbon waxes such as a polyethylene oxide wax and block copolymers thereof; waxes mainly composed of fatty acid esters such as a carnauba wax, a sasol wax, and a montanic acid ester wax; and partially or wholly deacidified fatty acid esters such as a deacidified carnauba wax.

Further examples of the wax include: straight-chain saturated fatty acids such as palmitic acid, stearic acid, and montanic acid; unsaturated fatty acids such as brassidic acid, eleostearic acid, and parinaric acid; saturated alcohols such as stearyl alcohol, aralkyl alcohol, behenyl alcohol, carnaubyl alcohol, ceryl alcohol, and melissyl alcohol; alkyl alcohols having a long-chain; polyhydric alcohols such as sorbitol; fatty acid amides such as linoleic amide, oleic amide, and lauric amide; saturated fatty acid bis amides such as methylene bis stearamide, ethylene bis capramide, ethylene bis lauramide, and hexamethylene bis stearamide; unsaturated fatty acid amides such as ethylene bis oleamide, hexamethylene bis oleamide, N,N'-dioleyl adipamide, and N,N-dioleyl sebacamide; aromatic bis amides such as m-xylene bis stearamide and N,N-distearyl isophthalamide; fatty acid metal salts (what are generally referred to as metallic soaps) such as calcium stearate, calcium laurate, zinc stearate, and magnesium stearate; graft waxes of which aliphatic hydrocarbon waxes are grafted with vinyl-based monomers such as styrene and acrylic acid; partially esterified compounds of fatty acids and polyhydric alcohols such as behenic monoglyceride; and methyl ester compounds having hydroxyl groups obtained by hydrogenation of vegetable oil.

In addition, the melting point of the above wax specified by the peak temperature of the highest endothermic peak at the time of temperature increase measured with a differential scanning calorimeter (DSC) is preferably 70 to 140° C., or more preferably 90 to 135° C. When the melting point is lower than 70° C., the following tendency arises: the viscosity of the toner reduces, so the adhesion of the toner to a photosensitive member is apt to occur. When the melting point exceeds 140° C., the low-temperature fixability of the toner tends to reduce.

The peak temperature of the highest endothermic peak (hereinafter referred to as melting point) of the wax is measured with a differential scanning calorimeter "Q1000" (manufactured by TA Instruments) in conformance with ASTM D3418-82.

A temperature correction for the detecting portion of the apparatus is performed by using the melting point of each of indium and zinc, and a heat quantity correction for the portion is performed by using the heat of melting of indium.

To be specific, about 10 mg of a wax are precisely weighed and loaded into an aluminum pan. The measurement is performed in the measurement temperature range of 30 to 200° C. at a rate of temperature increase of 10° C./min by using an empty aluminum pan as a reference. It should be noted that, in the measurement, the temperature is increased to 200° C. once, is subsequently decreased to 30° C., and the temperature of the sample is then increased again. The highest endothermic peak of a DSC curve in the temperature range of 30 to 200° C. in the second temperature increase process is defined as the highest endothermic peak of an endothermic curve in the DSC measurement. The peak temperature of the highest endothermic peak is then determined.

The above wax is added in an amount of preferably 0.1 to 20 parts by mass, or more preferably 0.5 to 10 parts by mass per 100 parts by mass of the binder resin.

In addition, such wax can be incorporated into the binder resin by, for example, a method involving dissolving the resin in a solvent at the time of the production of the binder resin, increasing the temperature of the resin solution, and adding and mixing the wax in the solution while stirring the solution, or a method involving adding the wax at the time of the melt kneading during the production of the toner particles.

The inorganic fine particles are added to the toner particles of the toner of the present invention for improving the flowability of the toner. Examples of the above inorganic fine particles include: fluorine-based resin fine particles such as vinylidene fluoride fine particles and polytetrafluoroethylene fine particles; and a fine particulate silica such as a wet process silica or a dry process silica, a fine particulate titanium oxide, a fine particulate alumina, and a treated silica, treated titanium oxide, or treated alumina obtained by subjecting any one of them to a surface treatment (hydrophobic treatment) with a silane coupling agent, a titanium coupling agent, silicone oil, or the like.

Of those, as the inorganic fine particles, inorganic fine particles produced by the vapor-phase oxidation of a silicon halide, the fine particles being the so-called dry process silica or fumed silica, is preferable. The fine particles is, for example, one obtained by utilizing a thermal decomposition oxidation reaction for a silicon tetrachloride gas in oxygen and hydrogen, and a reaction formula that provides a basis for the reaction is as described below.

$$SiCl_4+2H_2+O_2\rightarrow SiO_2+4HCl$$

Composite fine powder of silica and any other metal oxide can also be obtained by using any other metal halide such as aluminum chloride or titanium chloride and the silicon halide in combination in the production process, and the composite fine powder is also included in the category of the inorganic fine particles. With regard to the particle diameters of the inorganic fine particles, the inorganic fine particles have a number-average primary particle diameter in the range of preferably 0.001 to 2 μm, or particularly preferably 0.002 to 0.2 μm.

Commercially available silica fine particles produced by the vapor-phase oxidation of a silicon halide are, for example, those commercially available under the following tradenames:

AEROSIL 130, 200, 300, 380, TT600, MOX170, MOX80, and COK84 (all of which are available from NIPPON AEROSIL CO., LTD.); Ca—O—SiL M-5, MS-7, MS-75, HS-5, and EH-5 (all of which are available from CABOT Co.); WackerHDK N20, V15, N20E, T30, and T40 (all of which are available from WACKER-CHEMIE GMBH); D-C Fine SiliCa (DOW CORNING Co.); and Fransol (Fransil).

Further, the silica fine particles produced by the vapor-phase oxidation of a silicon halide are more preferably treated silica fine particles with their surfaces subjected to a hydrophobic treatment. The treated silica fine particles are particularly preferably products obtained by treating the silica fine particles so that the degree of hydrophobicity of each of the fine particles measured by a methanol titration test may show a value in the range of 30 to 80.

A method for the above hydrophobic treatment is, for example, a method involving chemically treating the silica fine particles with an organosilicon compound and/or silicone oil which may react with, or physically adsorb to, the silica fine particles. A method involving chemically treating the silica fine particles produced by the vapor-phase oxidation of a silicon halide with an organosilicon compound is an example of a preferable method.

As the organosilicon compound, the following are exemplified: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilylacrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane which has 2 to 12 siloxane units per molecule and contains a hydroxyl group bound to Si within a unit located in each of terminals. One of those compounds is used alone or mixture of two or more thereof is used.

Further, the silane coupling agents such as aminopropyltrimethoxy silane, aminopropyltriethoxy silane, dimethylaminopropyltrimethoxy silane, diethylaminopropyltrimethoxy silane, dipropylaminopropyltrimethoxy silane, dibutylaminopropyltrimethoxy silane, monobutylaminopropyltrimethoxy silane, dioctylaminopropyldimethoxy silane, dibutylaminopropyldimethoxy silane, dibutylaminopropylmonomethoxy silane, dimethylaminophenyltriethoxy silane, trimethoxysilyl-γ-propyphenyl amine, trimethoxysilyl-γ-propylbenzyl amine, having a nitrogen atom may be used alone or in combination. Preferable silane coupling agents include hexamethyldisilazane (HMDS).

The above-mentioned silicone oil has a viscosity at 25° C. of preferably 0.5 to 10,000 $mm^2/s$, more preferably 1 to 1,000 $mm^2/s$, or still more preferably 10 to 200 $mm^2/s$. Specific examples thereof include dimethyl silicone oil, methylphenyl silicone oil, α-methylstyrene modified silicone oil, chlorophenyl silicone oil, and fluorine-modified silicone oil.

A method for the treatment with the silicone oil is, for example, a method involving directly mixing silica fine particles treated with a silane coupling agent and the silicone oil with a mixer such as a Henschel mixer, a method involving spraying the silicone oil on silica fine particles each serving as a base, or a method involving dissolving or dispersing the silicone oil in a proper solvent, adding and mixing silica fine particles in the resultant, and removing the solvent.

The silica treated with the silicone oil is more preferably subjected to the following procedure: after the treatment with the silicone oil, the silica is heated to 200° C. or higher (more preferably 250° C. or higher) in an inert gas so that its surface coat may be stabilized.

Also usable in the present invention is a product obtained by a method involving treating the silica in advance with a coupling agent and treating the resultant with the silicone oil or a method involving treating the silica with a coupling agent and the silicone oil simultaneously.

The above inorganic fine particles have a specific surface area by a BET method based on nitrogen adsorption of preferably 30 $m^2/g$ or more, or more preferably 50 $m^2/g$ or more.

In addition, the above inorganic fine particles are added in an amount of preferably 0.01 to 8 parts by mass, or more preferably 0.1 to 4 parts by mass with respect to 100 parts by mass of the toner particles.

The above specific surface area by a BET method based on nitrogen adsorption is measured in conformity with JIS Z8830 (2001). A measuring apparatus used here is a "automatic specific surface area/pore distribution-measuring apparatus TriStar3000 (manufactured by Shimadzu Corporation)" which adopts a gas adsorption method based on a constant volume method as a measuring system.

A method of producing the toner of the present invention is not particularly limited, and any one of the known toner production methods can be employed. Of those production methods, a production method by which the diameter of each toner particle can be easily controlled to a desired one is more preferable.

A specific example of the above production method is described below. First, the binder resin, the wax, and the magnetic iron oxide, and, as required, any other additive such as a charge control agent are subjected to dry mixing with a mixer such as a Henschel mixer or a ball mill. The resultant mixture is melted and kneaded with a heat kneader such as a kneader, a roll mill, or an extruder so that the resins may be compatible with each other. The resultant molten kneaded product is solidified by cooling. After that, the solidified product is coarsely pulverized. The resultant coarsely pulverized products are finely pulverized with a collision type air pulverizer such as a jet mill, a Micronjet, or an IDS mill, or with a mechanical pulverizer such as a Kryptron, a Turbo mill, or an Inomizer. The resultant finely pulverized products are classified with an air classifier or the like so as to have a desired grain size distribution. Thus, toner particles are obtained. Then, the above inorganic fine particles are externally added and mixed in the toner particles. Thus, the toner of the present invention is obtained.

The above toner particles have a weight-average particle diameter (D4) of preferably 3.0 to 10.0 μm, more preferably 3.5 to 9.0 μm, or still more preferably 4.0 to 8.0 μm. When the weight-average particle diameter (D4) of the toner particles is smaller than 3.0 μm, fogging and scattering are apt to occur. In addition, the handleability of the toner is apt to reduce. On the other hand, when the D4 is larger than 10.0 μm, a problem is apt to arise in an attempt to improve the quality of an image formed with the toner owing to the sizes of the toner particles themselves. In addition, the consumption of the toner tends to increase, so such large weight-average particle diameter as described above is disadvantageous for a reduction in size of an image-forming apparatus.

The grain size distribution of the toner, which can be measured by any one of the various methods, is measured with a Coulter Counter Multisizer in the present invention.

<Weight-Average Particle Diameter (D4) and Number-Average Particle Diameter (D1)>

The weight-average particle diameter (D4) and the number-average particle diameter (D1) of the toner is measured in the following manner. A precision grain size distribution measuring apparatus based on a pore electrical resistance method provided with a 100-μm aperture tube "Coulter Counter Multisizer 3" (registered trademark, manufactured by Beckman Coulter, Inc) is used as a measuring apparatus. A dedicated software included with the apparatus "Beckman Coulter Multisizer 3 Version 3.51" (manufactured by Beckman Coulter, Inc) is used for setting measurement conditions and analyzing measurement data. It should be noted that the measurement is performed while the number of effective measurement channels is set to 25,000.

An electrolyte solution prepared by dissolving reagent grade sodium chloride in ion-exchanged water to have a concentration of about 1 mass %, for example, an "ISOTON II" (manufactured by Beckman Coulter, Inc) can be used in the measurement.

It should be noted that the dedicated software was set as described below prior to the measurement and the analysis.

In the "change of standard measurement method (SOM)" screen of the dedicated software, the total count number of a control mode is set to 50,000 particles, the number of times of measurement is set to 1, and a value obtained by using "standard particles each having a particle diameter of 10.0 μm" (manufactured by Beckman Coulter, Inc) is set as a Kd value. A threshold and a noise level are automatically set by pressing a "threshold/noise level measurement" button. In addition, a current is set to 1,600 μA, a gain is set to 2, and an electrolyte solution is set to an ISOTON II, and a check mark is placed in a check box as to whether the aperture tube is flushed after the measurement.

In the "setting for conversion from pulse to particle diameter" screen of the dedicated software, a bin interval is set to a logarithmic particle diameter, the number of particle diameter bins is set to 256, and a particle diameter range is set to the range of 2 μm to 60 μm.

A specific measurement method is as described below.

(1) About 200 ml of the electrolyte solution are charged into a 250-ml round-bottom beaker made of glass dedicated for the Multisizer 3. The beaker is set in a sample stand, and the electrolyte solution in the beaker is stirred with a stirrer rod at 24 rotations/sec in a counterclockwise direction. Then, dirt and bubbles in the aperture tube are removed by the "aperture flush" function of the analysis software.

(2) About 30 ml of the electrolyte solution are charged into a 100-ml flat-bottom beaker made of glass. About 0.3 ml of a diluted solution prepared by diluting a "Contaminon N" (a 10-mass % aqueous solution of a neutral detergent for washing a precision measuring device formed of a nonionic surfactant, an anionic surfactant, and an organic builder and having a pH of 7, manufactured by Wako Pure Chemical Industries, Ltd.) with ion-exchanged water by three mass-fold is added as a dispersant to the electrolyte solution.

(3) An ultrasonic dispersing unit "Ultrasonic Dispension System Tetora 150" (manufactured by Nikkaki Bios Co., Ltd.) in which two oscillators each having an oscillatory frequency of 50 kHz are built so as to be out of phase by 180° and which had an electrical output of 120 W is prepared. About 3.3 l of ion-exchanged water is charged into the water tank of the ultrasonic dispersing unit. About 2 ml of the Contaminon N are added to the water tank.

(4) The beaker in the section (2) is set in the beaker fixing hole of the ultrasonic dispersing unit, and the ultrasonic dispersing unit is operated. Then, the height position of the beaker is adjusted in order that the liquid level of the electrolyte solution in the beaker might resonate with an ultrasonic wave from the ultrasonic dispersing unit to the fullest extent possible.

(5) About 10 mg of toner are gradually added to and dispersed in the electrolyte solution in the beaker in the section (4) in a state where the electrolyte solution is irradiated with the ultrasonic wave. Then, the ultrasonic dispersion treatment is continued for an additional 60 seconds. It should be noted that the temperature of water in the water tank is appropriately adjusted so as to be 10° C. or higher and 40° C. or lower upon ultrasonic dispersion.

(6) The electrolyte solution in the section (5) in which the toner had been dispersed is dropped with a pipette to the round-bottom beaker in the section (1) placed in the sample stand, and the concentration of the toner to be measured is adjusted to about 5%. Then, measurement is performed until the particle diameters of 50,000 particles are measured.

(7) The measurement data is analyzed with the dedicated software included with the apparatus, and the weight-average particle diameter (D4) and the number-average particle diameter (D1) of the toner is calculated. It should be noted that an "average diameter" on the "analysis/volume statistics (arithmetic average)" screen of the dedicated software when the dedicated software is set to show a graph in a vol % unit is the weight-average particle diameter (D4) and when an "average diameter" on the "analysis/volume statistics (arithmetic average)" screen of the dedicated software when the dedicated software is set to show a graph in a number % unit is the number-average particle diameter (D1).

Examples of apparatuses used in the production of the toner include the following.

Examples of the mixer include the following: Henschel mixer (manufactured by MITSUI MINING CO., LTD.); Super mixer (manufactured by KAWATA MFG Co., Ltd.); Ribocone (manufactured by OKAWARA MFG. CO., LTD.); Nauta mixer, Turbulizer, and Cyclomix (manufactured by Hosokawa Micron Corporation); Spiral pin mixer (manufactured by Pacific Machinery & Engineering Co., Ltd.); and Redige mixer (manufactured by MATSUBO Corporation).

Further, examples of the kneader include the following: KRC kneader (manufactured by KURIMOTO, LTD.); Buss-Co-Kneader (manufactured by Coperion BUSS AG); TEM extruder (manufactured by TOSHIBA MACHINE CO., LTD.); TEX twin screw kneader (manufactured by The Japan Steel Works, LTD.); PCM kneader (manufactured by Ikegai, Ltd.); Three roll mill, Mixing roll mill, and Kneader (manufactured by INOUE MFG., INC.); Kneadex (manufactured by MITSUI MINING CO., LTD.); MS type pressurizing kneader, and Kneader ruder (manufactured by Moriyama Co., Ltd.); and Banbury mixer (manufactured by Kobe Steel, Ltd.).

Further, examples of the pulverizer include the following: Counter jet mill, Micron jet, and Inomizer (manufactured by Hosokawa Micron Corporation); IDS type mill, and PJM jet pulverizer (manufactured by Nippon Pneumatic Mfg. Co., Ltd.); Crossjet Mill (manufactured by KURIMOTO, LTD.); Ulmax (manufactured by NISSO ENGINEERING CO., LTD.); SK Jet-O-Mill (manufactured by Seishin Enterprise Co., Ltd.); Cliptron (manufactured by Kawasaki Heavy Industries, Ltd.); and Turbo Mill (manufactured by Turbo Kogyo Co., Ltd.).

Further, examples of the classifier include the following: Classiel, Micron Classifier, and Spedic Classifier (manufactured by Seishin Enterprise Co., Ltd.); Turbo Classifier (manufactured by Nisshin Engineering Inc.); Micron Separator, Turboplex (ATP), and TSP Separator (manufactured by Hosokawa Micron Corporation); Elbow-Jet (manufactured by Nittetsu Mining Co., Ltd.); Dispersion Separator (manufactured by Nippon Pneumatic Mfg. Co., Ltd.); and YM Microcut (manufactured by YASUKAWA ELECTRIC CORPORATION). Further, examples of the screening device for sifting coarse particles or the like include the following: Ultra Sonic (manufactured by Koei Sangyo Co., Ltd.); Resona Sieve, and Gyro Sifter (manufactured by Tokuju Corporation); Vibrasonic System (manufactured by Dalton Corporation); Soniclean (manufactured by Sintokogio, Ltd.); Turbo Screener (manufactured by Turbo Kogyo Co., Ltd.); Micro Sifter (manufactured by Makino Mfg. Co., Ltd.); and a circular vibrating screen.

EXAMPLES

Hereinafter, the present invention is described by way of examples. However, the present invention is not limited to these examples. It should be noted that the term "part(s)" in the following formulation means "part(s) by mass" unless otherwise stated.

Magnetic Iron Oxide Production Example 1

Step 1

First, 8.1 L of an aqueous solution of ferrous sulfate containing 1.8 mol/L of $Fe^{2+}$, 75 g of sodium silicate having an Si content of 13.4%, and 1.06 kg of sodium hydroxide were mixed, and water was added to the mixture so that the total amount of the solution might be 16.2 L. Air was blown at 2 L/min into the solution while the temperature and pH of the solution were maintained at 90° C. and 6 to 9, respectively. Then, ferrous hydroxide produced in the solution was subjected to wet oxidation. The formation of the central region of a magnetite was observed when 90% of the initial amount of ferrous hydroxide was consumed. The central region contained an Si element.

Step 2

The rate at which the oxidation reaction proceeded was examined by examining the concentration of unreacted ferrous hydroxide in the solution during the performance of Step 1. When 90% of the initial amount of ferrous hydroxide was consumed, 0.9 L of an aqueous solution of ferrous sulfate having the same concentration as that of the solution used in Step 1 described above and 70 g of titanyl sulfate having a Ti content of 20.0% were added to the solution, and further, water was added to the solution so that the amount of the solution might be 18 L. In addition, sodium hydroxide was added to the solution to adjust the pH of the solution to 9 to 12. Sodium silicate added in Step 1 remained in the solution. The wet oxidation was advanced by blowing air at 1 L/min into the solution at a liquid temperature of 90° C. Thus, an intermediate region formed of the magnetite containing the Si element and a Ti element was produced.

Step 3

During the performance of Step 2 described above, the blowing of air was stopped when 95% of the initial amount of unreacted ferrous hydroxide in the solution was consumed. Then, 15 g of sodium silicate having an Si content of 13.4% and 110 g of aluminum sulfate having an Al content of 6% were added to the solution. In addition, dilute sulfuric acid was added to adjust the pH of the solution to 5 to 9.

Magnetite particles thus obtained were washed, filtrated, dried, and pulverized by ordinary methods. The various properties of a magnetic iron oxide 1 thus obtained were measured. Table 1 shows the results.

Magnetic Iron Oxide Production Examples 2 to 9 and Comparative Magnetic Iron Oxide Production Examples 1 to 6

Magnetic iron oxides 2 to 9 and comparative magnetic iron oxides 1 to 6 were each obtained in the same manner as in the above magnetic iron oxide production example 1 except that: the amount of each of titanyl sulfate, sodium silicate, and aluminum sulfate was appropriately changed; and the timing of a shift from Step 1 to Step 2 involving adding titanyl sulfate and the timing of a shift from Step 2 to Step 3 involving adding aluminum sulfate (ratios at which ferrous hydroxide was consumed) were finely adjusted while the ratio at which ferrous hydroxide was consumed was monitored in each of Steps 1 and 2. The various properties of the magnetic iron oxides were measured. Table 1 shows the results.

Binder Resin Production Example 1

First, 4,000 g of a propylene oxide 2-mol adduct of bisphenol A, 2,800 g of a propylene oxide 3-mol adduct of bisphenol A, 1,200 g of terephthalic acid, 1,200 g of isophthalic acid, and 20 g of tetrabutyl titanate as a condensation catalyst were loaded into a reaction vessel provided with a cooling pipe, a stirring machine, and a nitrogen-introducing pipe, and the mixture was subjected to a reaction at 220° C. in a stream of nitrogen for 10 hours while water produced during the reaction was removed by distillation. Next, the resultant was subjected to a reaction under a reduced pressure of 5 to 20 mmHg, and, when the acid value of the resultant became 2 mgKOH/g or less, the resultant was cooled to 180° C. Then, 250 g of trimellitic anhydride were added to the resultant, and the mixture was subjected to a reaction under normal pressure for 2 hours while the reaction vessel was hermetically sealed. After that, the resultant was taken out and cooled to room temperature, and then the cooled product was pulverized. As a result, a polyester resin 1 (having a glass transition point (Tg) of 61.0° C., an acid value of 18.5 mgKOH/g, and a dielectric loss tangent at 140° C. of 0.045) was obtained.

Production Example 1 of Polymer A Having Sulfonic Group, Sulfonate Group, or Sulfonic Acid Ester Group

| | |
|---|---|
| Methanol | 300 g |
| Toluene | 100 g |
| Styrene | 470 g |
| 2-ethylhexyl acrylate | 78 g |
| 2-acrylamide-2-methylpropanesulfonic acid | 42 g |
| Lauroyl peroxide | 6 g |

The above raw materials were loaded into a flask. The flask was mounted with a stirring apparatus, a temperature-measuring apparatus, and a nitrogen-introducing apparatus, and the mixture was subjected to solution polymerization under a nitrogen atmosphere at 70° C. The foregoing state was retained for 10 hours before the polymerization reaction was completed. The resultant polymer was dried under reduced pressure and coarsely pulverized. As a result, a polymer A-1 having a weight-average molecular weight (Mw) of 31,500, a glass transition point (Tg) of 71.8° C., an acid value of 15 mgKOH/g, and a number-average particle diameter of 410 μm was obtained.

Toner Production Example 1

| | |
|---|---|
| Polyester resin 1 | 100 parts by mass |
| Wax (Low-molecular-weight polyethylene, melting point 102° C., Mn = 850 ) | 4.0 parts by mass |
| Magnetic iron oxide 1 (Composition: $Fe_3O_4$, shape: spherical, number-average particle diameter 0.19 μm, magnetic characteristics in 795.8 kA/m; coercive force (Hc) = 5.7 kA/m, saturation magnetization (σs) = 83.0 $Am^2/kg$, residual magnetization (σr) = 6.8 $Am^2/kg$) | 95 parts by mass |
| Polymer A-1 | 1.5 parts by mass |
| Exemplified azo-based iron compound (1) [using a sodium ion as a counter ion] | 1.0 part by mass |
| Exemplified Al salicylate compound (1) | 0.5 part by mass |

The above raw materials were preliminarily mixed with a Henschel mixer set at 450 rpm for 3 minutes. After that, the mixture was melted and kneaded with a biaxial kneading extruder set at 130 rpm while the set temperature of the extruder was adjusted so that a direct temperature near an outlet for a kneaded product might be 150 to 160° C. The resultant kneaded product was cooled and coarsely pulverized with a cutter mill. After that, the resultant coarsely pulverized products were finely pulverized with a Turbo mill (manufactured by Turbo Kogyo Co.), and were then classified with a multi-division classifier utilizing Coanda effect. As a result, negatively chargeable magnetic toner particles 1 having a weight-average particle diameter (D4) of 6.8 μm were obtained.

Then, 1.3 parts by mass of hydrophobic silica fine particles (obtained by treating the surfaces of silica fine particles produced by the vapor-phase oxidation of a silicon halide compound and having a BET specific surface area of 200 $m^2/g$ with hexamethyldisilazane) were externally added and mixed in 100 parts by mass of the magnetic toner particles 1 with a Henschel mixer. As a result, Toner 1 was obtained. The magnetic iron oxide was taken out of Toner 1 by the above method, and was then subjected to fluorescent X-ray analysis so that ratios Is/Ia, Is/Ib, and (Is+Ia)/Ib might be calculated. Table 3 shows the results. In addition, Table 2 shows the result of the measurement of the dielectric loss tangent of the toner at 140° C.

Toner Production Examples 2 to 14

Toners 2 to 14 were each obtained in the same manner as in the toner production example 1 except that: the magnetic iron oxide in the toner production example 1 was changed as shown in Table 2; and the polymer A, the compound B, and the compound C in the toner production example 1 were used as shown in Table 2.

Table 2 shows the dielectric loss tangents of the respective toners. The magnetic iron oxide was taken out of each of Toners 2 and 3 by the above method, and was then subjected to fluorescent X-ray analysis so that ratios Is/Ia, Is/Ib, and (Is+Ia)/Ib might be calculated. Table 3 shows the results.

Comparative Toner Production Examples 1 to 6

Comparative Toners 1 to 6 were each obtained in the same manner as in the toner production example 1 except that: the magnetic iron oxide in the toner production example 1 was changed as shown in Table 2; and the polymer A, the compound B, and the compound C in the toner production example 1 were used as shown in Table 2. Table 2 shows the dielectric loss tangents of the respective toners.

Example 1

Toner 1 was subjected to the following evaluations. Table 4 shows the results.

[Evaluation 1: Electrostatic Offset]

Evaluation for electrostatic offset was performed under a low-temperature, low-humidity environment (15° C., 10% RH) where toner was apt to be charged excessively and its fixing performance was apt to deteriorate because the electrostatic offset was exacerbated under the low-temperature, low-humidity environment.

An evaluation machine obtained by the following reconstruction was used: the fixation temperature of the fixing apparatus of a laser beam printer "Laser Jet 3005" manufactured by Hewlett-Packard Company was made arbitrarily settable, and its process speed was set at 350 mm/sec.

In addition, the process cartridge of the printer was reconstructed so as to have a volume twice as large as that before the reconstruction, and the reconstructed process cartridge was loaded with 1,000 g of Toner 1. The reconstructed cartridge was set in the evaluation machine, and was then left to stand under the low-temperature, low-humidity environment (15° C., 10% RH) overnight.

On the next day, under the low-temperature, low-humidity environment (15° C., 10% RH), the fixation temperature of the evaluation machine was adjusted by being lowered from its default value by 25° C. A 3-cm square isolated dot image (with its image density set at 0.5 to 0.6) was output on a FOX RIVER BOND paper (90 $g/m^2$) that had been left to stand under the low-temperature, low-humidity environment (15° C., 10% RH) for 24 hours. After that, the level of electrostatic offset occurring in a solid white portion below the dot image was visually judged.

Judgement criteria for the electrostatic offset are described below. In the present invention, a rank C or higher is preferable.

A: No electrostatic offset can be visually observed.

B: Extremely slight electrostatic offset can be observed.

C: A portion that is offset can be found at first sight, but a portion that is not offset is present.

D: A 3-cm square quadrangle can be clearly observed.

[Evaluation 2: Fixation Tailing]

Evaluation for fixation tailing was performed under a high-temperature, high-humidity environment (32.5° C., 85% RH) where the amount of water vapor produced from paper was large because the fixation tailing was apt to be worse under the high-temperature, high-humidity environment.

After the reconstructed process cartridge used in Evaluation 1 had been loaded with 1,000 g of Toner 1, the evaluation machine mounted with the reconstructed process cartridge was left to stand under the high-temperature, high-humidity environment (32.5° C., 85% RH) overnight.

On the next day, under the high-temperature, high-humidity environment, the fixation temperature of the evaluation machine was adjusted by being lowered from its default value by 25° C. After that, horizontal line images in which 4-dot lines were arranged at a space of 20 dots were output on a FOX RIVER BOND paper [90 $g/m^2$] that had been left to stand under the same high-temperature, high-humidity environment (32.5° C., 85% RH) for 3 days (which may hereinafter be referred to as "left paper"). At the same time, the same horizontal line images as those described above were output on a FOX RIVER BOND paper [90 $g/m^2$] immediately after opening which had not been left to stand under the above environment (which may hereinafter be referred to as "immediately-after-opening paper"). The level of fixation tailing that occurred was visually evaluated.

Judgement criteria for the fixation tailing are described below. In the present invention, a rank C or higher is preferable.

A: No tailing portion can be observed at first sight even on the left paper.

B: Tailing occurs on the left paper to some extent, but no tailing portion can be observed at first sight on the immediately-after-opening paper.

C: Tailing occurs at two or three sites per line even on the immediately-after-opening paper.

D: Tailing occurs at a large number of sites (three or more sites per line) even on the immediately-after-opening paper.

[Evaluation 3: Reduction in Image Density at Time of Start-Up of Image-Forming Apparatus after Standing]

Evaluation for a reduction in image density occurring at the time of the start-up of an image-forming apparatus after toner had been left to stand for a certain time period was performed under a high-temperature, high-humidity environment (32.5° C., 80% RH) where the rise-up of the charge quantity of the toner was apt to be slow because the reduction was apt to be worse under the high-temperature, high-humidity environment.

After the reconstructed process cartridge used in Evaluation 1 had been loaded with 1,000 g of Toner 1, the evaluation machine mounted with the reconstructed process cartridge was left to stand-under the high-temperature, high-humidity environment (32.5° C., 80% RH) overnight.

A 20,000-sheet print durability test was performed with the above evaluation machine as an image output testing machine on A4-size plain paper (75 g/m$^2$) according to the following mode: the printing of a horizontal line pattern having a print percentage of 1.5% on one sheet was defined as one job, and the machine was set so as to stop once between one job and a next job before the next job started. The image density of a solid image after the completion of the printing on 20,000 sheets was measured, and then the machine was left to stand as it was under the environment for 7 days. After that, a solid image was output again, and its image density was measured.

The term "image density" refers to the density of a printed-out image measured with a "Macbeth reflection densitometer" (manufactured by Macbeth Co.) relative to a blank portion having a manuscript density of 0.00.

Judgement criteria for the above reduction in image density are described below. In the present invention, a rank C or higher is preferable.

A: The density reduced by less than 0.10 as compared to the density before the standing for 7 days.

B: The density reduced by less than 0.15 as compared to the density before the standing for 7 days.

C: The density reduced by less than 0.25 as compared to the density before the standing for 7 days.

D: The density reduced by 0.25 or more as compared to the density before the standing for 7 days.

[Evaluation 4: Fogging in Morning]

Evaluation for fogging in the morning occurring at the time of the start-up of an image-forming apparatus in the morning after toner had been left to stand overnight was performed under a low-temperature, low-humidity environment (15° C., 10% RH) where the toner was apt to be charged excessively because the fogging was apt to be worse under the low-temperature, low-humidity environment.

After the reconstructed process cartridge used in Evaluation 1 had been loaded with 1,000 g of Toner 1, the evaluation machine mounted with the reconstructed process cartridge was left to stand under the low-temperature, low-humidity environment (15° C., 10% RH) overnight.

A 5,000-sheet print durability test was performed with the above evaluation machine as an image output testing machine on A4-size plain paper (75 g/m$^2$) according to the following mode: the printing of a horizontal line pattern having a print percentage of 1.5% on one sheet was defined as one job, and the machine was set so as to stop once between one job and a next job before the next job started.

After the completion of the printing on 5,000 sheets, the machine was left to stand as it was under the low-temperature, low-humidity environment (15° C., 10% RH) overnight. The next morning, a solid white image was output and evaluated for fogging in the morning. Fogging (%) was calculated by comparing the degree of whiteness of transfer paper measured with a REFLECTOMETER (manufactured by Tokyo Denshoku CO., LTD.) and the degree of whiteness of the transfer paper after the printing of the solid white image.

Judgement criteria for the fogging are described below. In the present invention, a rank C or higher is preferable.

A: The maximum fogging in the paper surface is less than 1.0%.

B: The maximum fogging in the paper surface is less than 1.5%.

C: The maximum fogging in the paper surface is less than 2.5%.

D: The maximum fogging in the paper surface is 2.5% or more.

Examples 2 to 14

The same evaluations as those of Example 1 were performed by using any one of Toners 2 to 14 instead of Toner 1. Table 4 shows the results of the evaluations.

Comparative Examples 1 to 7

The same evaluations as those of Example 1 were performed by using any one of Comparative Toners 1 to 7 instead of Toner 1. Table 4 shows the results of the evaluations.

TABLE 1

| | *1 described below [mass %] | *2 described below [mass %] | *3 described below [%] | *4 described below [%] | *5 described below [mass %] |
|---|---|---|---|---|---|
| Magnetic iron oxide 1 | 1 | 0.5 | 86 | 100 | 0.7 |
| Magnetic iron oxide 2 | 0.31 | 0.5 | 91 | 100 | 0.2 |
| Magnetic iron oxide 3 | 4.9 | 0.5 | 72 | 96.5 | 2.57 |
| Magnetic iron oxide 4 | 0.31 | 0.25 | 77 | 98 | 0.25 |
| Magnetic iron oxide 5 | 4.9 | 2.2 | 78 | 98.5 | 4 |
| Magnetic iron oxide 6 | 0.31 | 0.11 | 76 | 97.2 | 0.13 |
| Magnetic iron oxide 7 | 4.9 | 2.9 | 82 | 100 | 3.76 |
| Magnetic iron oxide 8 | 0.4 | 2.9 | 93.5 | 100 | 0.4 |
| Magnetic iron oxide 9 | 4.9 | 0.11 | 71 | 95 | 0.74 |
| Comparative magnetic iron oxide 1 | 0.32 | 0.09 | 73 | 96.8 | 0.13 |
| Comparative magnetic iron oxide 2 | 0.29 | 0.09 | 74 | 97 | 0.12 |
| Comparative magnetic iron oxide 3 | 5.1 | 2.9 | 81 | 100 | 4.08 |
| Comparative magnetic iron oxide 4 | 5.1 | 3.1 | 82.5 | 100 | 3.91 |
| Comparative magnetic iron oxide 5 | 0.31 | 2.9 | 94.5 | 100 | 0.3 |
| Comparative magnetic iron oxide 6 | 4.9 | 0.11 | 69 | 94 | 0.83 |

| | *6 described below [mass %] | *7 described below | *8 described below [%] | *9 described below [mass %] | *10 described below |
|---|---|---|---|---|---|
| Magnetic iron oxide 1 | 0.07 | 10 | 18 | 0.28 | 2.5 |
| Magnetic iron oxide 2 | 0.05 | 4.5 | 22 | 0.11 | 1.8 |
| Magnetic iron oxide 3 | 0.12 | 21 | 13 | 0.54 | 4.8 |
| Magnetic iron oxide 4 | 0.05 | 5 | 29.5 | 0.38 | 0.9 |

TABLE 1-continued

| | | | | | |
|---|---|---|---|---|---|
| Magnetic iron oxide 5 | 0.45 | 8.9 | 5.2 | 1.19 | 5.1 |
| Magnetic iron oxide 6 | 0.02 | 5.4 | 31 | 0.16 | 0.8 |
| Magnetic iron oxide 7 | 0.52 | 7 | 4.8 | 0.7 | 5.4 |
| Magnetic iron oxide 8 | 0.19 | 2.1 | 32 | 0.44 | 0.9 |
| Magnetic iron oxide 9 | 0.03 | 28 | 4.7 | 0.14 | 5.2 |
| Comparative magnetic iron oxide 1 | 0.02 | 6.2 | 33 | 0.15 | 0.9 |
| Comparative magnetic iron oxide 2 | 0.02 | 6 | 34 | 0.16 | 0.8 |
| Comparative magnetic iron oxide 3 | 0.55 | 7.4 | 4.6 | 0.74 | 5.5 |
| Comparative magnetic iron oxide 4 | 0.54 | 7.2 | 4.3 | 0.72 | 5.4 |
| Comparative magnetic iron oxide 5 | 0.16 | 1.9 | 32.5 | 0.38 | 0.8 |
| Comparative magnetic iron oxide 6 | 0.03 | 30.2 | 4.8 | 0.16 | 5.1 |

(*1) The total Ti component amount (in terms of a Ti element: [mass %]) in a magnetic iron oxide
(*2) The total Al component amount (in terms of an Al element: [mass %]) in a magnetic iron oxide
(*3) A ratio (%) of an Al component amount eluted when a magnetic iron oxide is loaded into an alkaline aqueous solution and the Al component in the magnetic iron oxide is eluted with the alkaline aqueous solution to the total Al component amount in the magnetic iron oxide
(*4) A ratio (%) of the sum of the Al component amount in a solution with an Fe element dissolution ratio of 10 mass % and the Al component amount eluted when a magnetic iron oxide is loaded into an alkaline aqueous solution and the Al component in the magnetic iron oxide is eluted with the alkaline aqueous solution to the total Al component amount in the magnetic iron oxide
(*5) A Ti component amount (in terms of a Ti element: [mass %]) in a solution with an Fe element dissolution ratio of 10 mass %
(*6) An Al component amount (in terms of an Al element: [mass %]) in a solution with an Fe element dissolution ratio of 10 mass %
(*7) A ratio (Ti component amount in terms of Ti element/Al component amount in terms of Al element) of a Ti component amount in terms of a Ti element in a solution with an Fe element dissolution ratio of 10 mass % to an Al component amount in terms of an Al element in the solution
(*8) A ratio (%) of an Si component amount eluted when a magnetic iron oxide is loaded into an alkaline aqueous solution and the Si component in the magnetic iron oxide is eluted with the alkaline aqueous solution to the total Si component amount in the magnetic iron oxide
(*9) An Si component amount (in terms of an Si element: [mass %]) in a solution with an Fe element dissolution ratio of 10 mass %
(*10) A ratio (Ti component amount in terms of Ti element/Si component amount in terms of Si element) of a Ti component amount in terms of a Ti element in a solution with an Fe element dissolution ratio of 10 mass % to an Si component amount in terms of an Si element in the solution

TABLE 2

<Toner prescription>

| Toner | Magnetic iron oxide | Polymer A | Part(s) by mass | Compound B | Part(s) by mass | Compound C | Part(s) by mass | Dielectric loss tangent |
|---|---|---|---|---|---|---|---|---|
| Toner 1 | Magnetic iron oxide 1 | Polymer A-1 | 1.5 | Exemplified Al salicylate compound (1) | 0.5 | Azo-based iron compound (1) using sodium ion as counter | 1 | $2.5 \times 10^{-1}$ |
| Toner 2 | Magnetic iron oxide 1 | Polymer A-1 | 4.1 | Exemplified Zn salicylate compound (1) | 0.5 | Azo-based iron compound (1) using sodium ion as counter | 0.8 | $1.8 \times 10^{-1}$ |
| Toner 3 | Magnetic iron oxide 1 | Polymer A-1 | 1.5 | Exemplified Zn salicylate compound (1) | 0.5 | Azo-based iron compound (1) using ammonium ion as counter | 1 | $2.2 \times 10^{-1}$ |
| Toner 4 | Magnetic iron oxide 1 | Polymer A-1 | 1.5 | Exemplified Zr salicylate compound (1) | 0.5 | — | — | $0.1 \times 10^{-1}$ |
| Toner 5 | Magnetic iron oxide | Polymer A-1 | 6 | — | — | — | — | $3.0 \times 10^{-3}$ |
| Toner 6 | Magnetic iron oxide 1 | — | — | — | — | Azo-based iron compound (1) using sodium ion as counter | 2 | $3.8 \times 10^{-1}$ |
| Toner 7 | Magnetic iron oxide 2 | — | — | — | — | Azo-based iron compound (1) using sodium ion as counter | 2 | $4.6 \times 10^{-1}$ |
| Toner 8 | Magnetic iron oxide 3 | — | — | — | — | Azo-based iron compound (1) using sodium ion as counter | 2 | $2.0 \times 10^{-1}$ |
| Toner 9 | Magnetic iron oxide 4 | — | — | — | — | Azo-based iron compound (1) using sodium ion as counter | 2 | $4.7 \times 10^{-1}$ |
| Toner 10 | Magnetic iron oxide 5 | — | — | — | — | Azo-based iron compound (1) using sodium ion as counter | 2 | $1.4 \times 10^{-1}$ |
| Toner 11 | Magnetic iron oxide 6 | — | — | — | — | Azo-based iron compound (1) using sodium ion as counter | 2 | $4.9 \times 10^{-1}$ |

TABLE 2-continued

| <Toner prescription> | | | | | | | | |
|---|---|---|---|---|---|---|---|---|
| Toner | Magnetic iron oxide | Polymer A | Part(s) by mass | Compound B | Part(s) by mass | Compound C | Part(s) by mass | Dielectric loss tangent |
| Toner 12 | Magnetic iron oxide 7 | — | — | — | — | Azo-based iron compound (1) using sodium ion as counter | 2 | $0.9 \times 10^{-1}$ |
| Toner 13 | Magnetic iron oxide 8 | — | — | — | — | Azo-based iron compound (1) using sodium ion as counter | 2 | $3.9 \times 10^{-1}$ |
| Toner 14 | Magnetic iron oxide 9 | — | — | — | — | Azo-based iron compound (1) using sodium ion as counter | 2 | $3.4 \times 10^{-1}$ |
| Comparative Toner 1 | Comparative magnetic iron oxide 1 | — | — | — | — | Azo-based iron compound (1) using sodium ion as counter | 2 | $5.4 \times 10^{-1}$ |
| Comparative Toner 2 | Comparative magnetic iron oxide 2 | — | — | — | — | Azo-based iron compound (1) using sodium ion as counter | 2 | $5.3 \times 10^{-1}$ |
| Comparative Toner 3 | Comparative magnetic iron oxide 3 | — | — | — | — | Azo-based iron compound (1) using sodium ion as counter | 2 | $0.8 \times 10^{-1}$ |
| Comparative Toner 4 | Comparative magnetic iron oxide 4 | — | — | — | — | Azo-based iron compound (1) using sodium ion as counter | 2 | $0.6 \times 10^{-1}$ |
| Comparative Toner 5 | Comparative magnetic iron oxide 5 | — | — | — | — | Azo-based iron compound (1) using sodium ion as counter | 2 | $4.1 \times 10^{-1}$ |
| Comparative Toner 6 | Comparative magnetic iron oxide 6 | — | — | — | — | Azo-based iron compound (1) using sodium ion as counter | 2 | $4.1 \times 10^{-1}$ |
| Comparative Toner 7 | Magnetic iron oxide 6 | — | — | — | — | Azo-based iron compound (1) using ammonium ion as counter | 6 | $5.1 \times 10^{-1}$ |

In the table, numerical values in the respective right columns each represent the number of parts by mass with respect to 100 parts by mass of a binder resin.

TABLE 3

| | MA/MB | MA/MC | MC/MB | MA + MB + MC | Is/Ia | Is/Ib | (Is + Ia)/Ib |
|---|---|---|---|---|---|---|---|
| Toner 1 | 3.0 | 1.5 | 2.0 | 3.0 | 0.50 | 0.70 | 5.0 |
| Toner 2 | 8.0 | 5.0 | 1.6 | 5.3 | 0.79 | 0.99 | 10.2 |
| Toner 3 | 3.0 | 1.5 | 2.0 | 3.0 | 0.49 | 0.72 | 5.1 |

TABLE 4

| <Results of evaluations> | | | | | |
|---|---|---|---|---|---|
| | Toner | Evaluation 1 | Evaluation 2 | Evaluation 3 | Evaluation 4 |
| Example 1 | Toner 1 | A | A | A (0.05) | A (0.5) |
| Example 2 | Toner 2 | A | B | A (0.06) | A (0.5) |
| Example 3 | Toner 3 | A | B | A (0.06) | A (0.6) |
| Example 4 | Toner 4 | A | B | A (0.05) | A (0.7) |
| Example 5 | Toner 5 | A | B | A (0.07) | B (1.2) |
| Example 6 | Toner 6 | B | B | A (0.09) | A (0.8) |
| Example 7 | Toner 7 | B | B | B (0.13) | B (1.2) |

TABLE 4-continued

| <Results of evaluations> | | | | | |
|---|---|---|---|---|---|
| | Toner | Evaluation 1 | Evaluation 2 | Evaluation 3 | Evaluation 4 |
| Example 8 | Toner 8 | B | B | B (0.12) | B (1.3) |
| Example 9 | Toner 9 | C | B | B (0.14) | B (1.3) |
| Example 10 | Toner 10 | B | B | C (0.18) | B (1.4) |
| Example 11 | Toner 11 | C | B | B (0.14) | C (1.8) |
| Example 12 | Toner 12 | C | B | C (0.19) | C (1.9) |
| Example 13 | Toner 13 | C | B | C (0.20) | C (2.0) |
| Example 14 | Toner 14 | C | C | C (0.20) | C (2.1) |
| Comparative Example 1 | Comparative Toner 1 | D | C | C (0.22) | C (2.1) |
| Comparative Example 2 | Comparative Toner 2 | D | D | C (0.21) | C (2.2) |
| Comparative Example 3 | Comparative Toner 3 | C | B | C (0.23) | D (2.6) |
| Comparative Example 4 | Comparative Toner 4 | C | C | D (0.28) | D (2.6) |
| Comparative Example 5 | Comparative Toner 5 | D | C | C (0.24) | C (2.4) |
| Comparative Example 6 | Comparative Toner 6 | C | D | D (0.30) | D (2.8) |
| Comparative Example 7 | Comparative Toner 7 | D | B | C (0.23) | C (2.0) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-191730, filed Jul. 25, 2008, which is hereby incorporated by reference herein in its entirety.

What is claimed is:

1. A toner, comprising:

toner particles each containing at least a binder resin, a wax, and a magnetic iron oxide; and inorganic fine particles, wherein:

(1) the magnetic iron oxide contains at least a Ti element, an Al element, an Si element, and an Fe element;

(2) a content of the Ti element in the magnetic iron oxide is 0.30 to 5.00 mass % with respect to an entirety of the magnetic iron oxide;

(3) a content of the Al element in the magnetic iron oxide is 0.10 to 3.00 mass % with respect to the entirety of the magnetic iron oxide;

(4) an Al element amount eluted when the magnetic iron oxide is loaded into an alkaline aqueous solution and the Al element in the magnetic iron oxide is eluted with the alkaline aqueous solution is 50.0% to 95.0% of a total Al element amount in the magnetic iron oxide;

(5) when an Fe element amount in a solution completely dissolving the magnetic iron oxide from which an Al element has been eluted with the alkaline aqueous solution in the section (4) is defined as a total Fe element amount, a sum of an Al element amount in a solution prepared by dissolving the magnetic iron oxide from which an Al element has been eluted with the alkaline aqueous solution in the section (4) in an acidic solution so that an Fe element amount therein reaches 10 mass % of the total Fe element amount (the solution being hereinafter referred to as a solution with an Fe element dissolution ratio of 10 mass %) and the Al element amount eluted in the section (4), accounts for 95.0% to 100.0% of the total Al element amount in the magnetic iron oxide; and (6) a ratio of a Ti element amount to the Al element amount (Ti element amount/Al element amount) in the solution with an Fe element dissolution ratio of 10 mass % is 2.0 to 30.0, and wherein the toner has a dielectric loss tangent calculated from its complex dielectric constant measured at a temperature of 140° C. a frequency of 10 kHz of $1.0\times10^{-3}$ to $5.0\times10^{-1}$.

2. A toner according to claim 1, wherein an Si element amount eluted when the magnetic iron oxide is eluted with the alkaline aqueous solution is 5.0% to 30.0% of a total Si element amount in the magnetic iron oxide.

3. A toner according to claim 1, wherein a ratio of the Ti element amount in the solution with an Fe element dissolution ratio of 10 mass % to an Si element amount in the solution (Ti element amount/Si element amount) is 1.0 to 5.0.

4. A toner according to claim 1, wherein the toner particles each contain a polymer A having a sulfonic group, a sulfonate group, or a sulfonic acid ester group.

5. A toner according to claim 1, wherein the toner particles each contain a polymer A having a sulfonic group, a sulfonate group, or a sulfonic acid ester group and a metal compound B of an aromatic oxycarboxylic acid or a derivative of the acid.

6. A toner according to claim 1, wherein the toner particles each contain a polymer A having a sulfonic group, a sulfonate group, or a sulfonic acid ester group, a metal compound B of an aromatic oxycarboxylic acid or a derivative of the acid, and an azo-based iron compound C.

7. A toner according to claim 1, wherein the alkaline aqueous solution is 1 mol/L NaOH solution, and the acidic aqueous solution is 0.5 mol/L $H_2SO_4$ solution.

* * * * *